US011109145B2

(12) United States Patent
Tang et al.

(10) Patent No.: US 11,109,145 B2
(45) Date of Patent: Aug. 31, 2021

(54) SPEAKER DEVICE AND RELATED ACOUSTIC DEFLECTING MODULE

(71) Applicant: Wistron Corporation, New Taipei (TW)

(72) Inventors: Wen-Lang Tang, New Taipei (TW); Chih-Feng Yeh, New Taipei (TW); Tsai-Wen Hsu, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 16/654,038

(22) Filed: Oct. 16, 2019

(65) Prior Publication Data

US 2021/0044892 A1 Feb. 11, 2021

(30) Foreign Application Priority Data

Aug. 7, 2019 (TW) ..... 108127977

(51) Int. Cl.
*H04R 1/28* (2006.01)
*H04R 1/34* (2006.01)
*H04R 1/02* (2006.01)

(52) U.S. Cl.
CPC ..... *H04R 1/2811* (2013.01); *H04R 1/025* (2013.01); *H04R 1/345* (2013.01)

(58) Field of Classification Search
CPC ..... H04R 1/2811; H04R 1/345; H04R 1/025
See application file for complete search history.

(56) References Cited

U.S. PATENT DOCUMENTS 2,263,408 A * 11/1941 Lakhovsky ..... H04R 1/34 181/242
3,816,672 A * 6/1974 Gefvert ..... H04R 1/345 381/352
4,200,170 A * 4/1980 Williams, Jr. ..... H04R 1/345 181/144
4,860,367 A * 8/1989 Hook ..... H04R 1/2865 381/341

(Continued)

FOREIGN PATENT DOCUMENTS

CN 20491236 * 7/2009 ..... H04R 1/28
CN 20491236 * 5/2010 ..... H04R 1/28

(Continued)

*Primary Examiner* — Oyesola C Ojo
(74) *Attorney, Agent, or Firm* — Winston Hsu

(57) ABSTRACT

A speaker device having a resonance chamber with adjustable volume can include a speaker chamber and an acoustic deflecting module. The speaker chamber has a transducer, and the audio signal generated by the speaker chamber can be output via the transducer. The acoustic deflecting module is disposed adjacent to the speaker chamber. An outer surface of the acoustic deflecting module changes a transmission direction of the audio signal. An inner volume of the acoustic deflecting module is the resonance chamber with the adjustable volume. The acoustic deflecting module includes a base, a cover, a plate and a driving mechanism. The cover is assembled with the base. The plate is movably disposed inside the cover to form a resonance chamber. The driving mechanism is disposed on the cover and assembled with the plate, and adapted to move the plate inside the resonance chamber for vary a volume of the resonance chamber.

19 Claims, 17 Drawing Sheets

(56) References Cited

U.S. PATENT DOCUMENTS

| | | | | | |
|---|---|---|---|---|---|
| 5,266,752 | A * | 11/1993 | Cussans | H04R 1/2865 | 181/153 |
| 6,122,386 | A * | 9/2000 | Wiley | H04R 5/02 | 181/155 |
| 8,627,920 | B2 * | 1/2014 | Moore | H04R 1/30 | 181/156 |
| 10,021,479 | B1 * | 7/2018 | Craig | H04R 1/20 | |
| 10,237,636 | B1 * | 3/2019 | Ivey | H04R 1/26 | |
| 2012/0170782 | A1 * | 7/2012 | Ettinger | H04R 1/028 | 381/332 |
| 2013/0259287 | A1 * | 10/2013 | Tseng | H04R 1/1016 | 381/380 |
| 2017/0332166 | A1 * | 11/2017 | Kikuchi | F21V 3/00 | |

FOREIGN PATENT DOCUMENTS

| | | | | |
|---|---|---|---|---|
| CN | 201491236 | * | 5/2010 | H04R 1/28 |
| CN | 203643853 | * | 8/2013 | G50D 3/12 |
| CN | 203193854 | | 9/2013 | |
| CN | 203643853 | * | 6/2014 | G05D 3/12 |
| CN | 207354573 | * | 11/2017 | H04R 1/20 |
| CN | 207354573 | * | 5/2018 | H04R 1/20 |
| CN | 207354573 U | | 5/2018 | |
| WO | WO-2014032313 A1 | * | 3/2014 | H04R 1/02 |

* cited by examiner

SPEAKER DEVICE AND RELATED ACOUSTIC DEFLECTING MODULE

BACKGROUND OF THE DISCLOSURE

1. Field of the Disclosure

The present disclosure relates to a speaker device, and more particularly, to a speaker device and an acoustic deflecting module having the resonance chamber with adjustable volume.

2. Description of the Prior Art

The sound volume and the audio frequency of the speaker device are decided by structural features of a resonance box of the speaker device. The resonance box which has large volume provides the loud sound volume; if the volume of the resonance box is small, the audio signal does not have satisfied sound quality. With the advanced technology, the smart speaker device may change a tone, a frequency and a range of the audio signal in accordance with specific circumstances. Conventional design about the speaker device assembles an upper cover with a lower cover in a movable manner to form the resonance box. The upper cover can be spaced from the lower cover, and a bridging component is connected between the upper cover and the lower cover to form the large-dimensional resonance box. The bridging component can be removed to directly connect the upper cover with the lower cover to form the small-dimensional resonance box. However, the conventional design does not consider tolerance of structural assembly, so that the sound quality generated by the resonance box consisted of the bridging component, the upper cover and the lower cover cannot conform to a user's demand.

SUMMARY OF THE DISCLOSURE

The present disclosure provides a speaker device and an acoustic deflecting module having the resonance chamber with adjustable volume for solving above drawbacks.

According to the claimed disclosure, a speaker device having a resonance chamber with adjustable volume is disclosed. The speaker device includes a speaker chamber and an acoustic deflecting module. The speaker chamber is adapted to generate and output an audio signal outwardly. The acoustic deflecting module is disposed adjacent to the speaker chamber. An outer surface of the acoustic deflecting module is adapted to change a transmission direction of the audio signal, and an inner volume of the acoustic deflecting module is used as the resonance chamber with the adjustable volume.

According to the claimed disclosure, the acoustic deflecting module includes a base, a cover, a plate and a driving mechanism. The cover is assembled with the base. The plate is movably disposed inside the cover to form the resonance chamber. The driving mechanism is disposed on the cover and assembled with the plate, and adapted to move the plate inside the resonance chamber for adjusting the volume of the resonance chamber.

According to the claimed disclosure, the driving mechanism includes a supporter, a first guiding component, a second guiding component and an operating component. The supporter is disposed on the base. The first guiding component has a first end and a second end opposite to each other. The first end is fixed to the plate, and the second end is movably disposed on the supporter. The second guiding component is movably disposed between the first end and the second end of the first guiding component. The operating component is disposed on the cover and assembled with the second guiding component. A movement of the operating component along different rotary directions shifts the plate along different linear directions so as to enlarge or reduce the volume of the resonance chamber.

According to the claimed disclosure, the movement of the operating component in a first rotary direction shifts the plate in a first linear direction via the second guiding component and the first guiding component for reducing the volume, and the movement of the operating component in a second rotary direction opposite to the first rotary direction shifts the plate in a second linear direction opposite to the first linear direction via the second guiding component and the first guiding component for enlarging the volume According to the claimed disclosure, the supporter is a track, and the first guiding component and the second guiding component respectively are a rack and a gear, and the rack is slidably disposed inside the track to engage with the gear.

According to the claimed disclosure, the acoustic deflecting module further includes a positioning mechanism disposed on the plate and adapted to restricting a relative movement between the plate and the cover.

According to the claimed disclosure, the positioning mechanism includes a positioning component and a resilient component. The positioning component abuts against a positioning slot formed on the cover in a detachable manner. An end of the resilient component is connected to the positioning component, and the other end of the resilient component is disposed inside an accommodating space of the plate.

According to the claimed disclosure, the cover has a chest structure. Any two sectional surfaces of the chest structure parallel to each other have the same sectional dimension, and an edge of the plate movably abuts against an inner wall of the chest structure.

According to the claimed disclosure, the cover has a first part and a second part. Any two sectional surfaces of the first part parallel to each other have different sectional dimensions. Any two sectional surfaces of the second part parallel to each other have the same sectional dimension, and the plate is movably disposed inside the second part.

According to the claimed disclosure, the acoustic deflecting module further includes two covers respectively having different thickness, and one of the two covers is assembled with the base in a detachable manner.

According to the claimed disclosure, the cover includes an opening structure, and the acoustic deflecting module further includes a sheltering mechanism disposed on the cover to shelter the opening structure in a switchable manner.

According to the claimed disclosure, the sheltering mechanism includes a plurality of sheltering components, a bridging component and a controlling component. The plurality of sheltering components is movably disposed on the cover in a partly overlapped manner. The bridging component is connected to the plurality of sheltering components. The controlling component is movably disposed on the cover and connected to the bridging component. A movement of the controlling component shifts the plurality of sheltering components in a relative manner via the bridging component for sheltering or exposing the opening structure.

According to the claimed disclosure, the plate includes a first mask and a second mask. A radial dimension of the first mask is greater than a radial dimension of the second mask.

The driving mechanism includes a supporter, a first guiding component, a second guiding component and an operating component. The supporter is disposed on the base. The first guiding component has a first end and a second end opposite to each other. The first end movably passes through the first mask to fix onto the second mask, and the second end is movably disposed on the supporter. The second guiding component is movably disposed between the first end and the second end of the first guiding component. The operating component is disposed on the cover and assembled with the second guiding component. The operating component utilizes a variety of movements to shift the second mask relative to the first mask for enlarging or reducing the volume of the resonance chamber According to the claimed disclosure, the first mask is fixed inside the cover, and the second mask is movably disposed on the first part, and the radial dimension of the second mask is greater than one sectional surface of the first part having the smallest sectional dimension According to the claimed disclosure, the movement of the operating component in a first rotary direction shifts the second mask far from the first mask via the second guiding component and the first guiding component for reducing the volume, and the movement of the operating component in a second rotary direction opposite to the first rotary direction shifts the second mask close to the first mask via the second guiding component and the first guiding component for enlarging the volume.

According to the claimed disclosure, the plate further includes a third mask. A radial dimension of the third mask is set between the radial dimension of the first mask and the radial dimension of the second mask. The first end of the first guiding component movably passes through the first mask and the third mask to fix onto the second mask. The operating component utilizes a variety of movements to shift the second mask and the third mask simultaneously, or shift the second mask relative to the third mask.

According to the claimed disclosure, the third mask is movably disposed on the first part and located between the first mask and the second mask.

According to the claimed disclosure, a first movement of the operating component in the first rotary direction drives the third mask to push the second mask via the second guiding component and the first guiding component for reducing the volume, and a second movement of the operating component in the first rotary direction further drives the second mask far from the third mask via the second guiding component and the first guiding component for further reducing the volume. The second movement is greater than the first movement.

According to the claimed disclosure, a third movement of the operating component in the second rotary direction moves the second mask close to the third mask via the second guiding component and the first guiding component for enlarging the volume, and a fourth movement of the operating component in the second rotary direction further moves the second mask and the third mask simultaneously close to the first mask via the second guiding component and the first guiding component for further enlarging the volume. The fourth movement is greater than the third movement.

According to the claimed disclosure, the driving mechanism further includes a constraining component disposed on the first guiding component. The constraining component moves the third mask and the second mask simultaneously in a first linear direction, and further to stay the third mask when the second mask shifts in a second linear direction opposite to the first linear direction.

According to the claimed disclosure, the constraining component is a block disposed on the first guiding component in a movable manner, and located between the first mask and the third mask.

The speaker device of the present disclosure can include the acoustic deflecting module capable of changing structural parameters of the acoustic deflecting module and the opening structure. The acoustic deflecting module can adjust the volume of the resonance box, the aperture of the opening structure, and the depth of the opening structure to change the resonant frequency of the audio signal via a variety of structural design. In the first embodiment, the plate can be moved inside the chest structure in the stepless manner for changing the volume of the resonance chamber. In the second embodiment, the plate can be moved inside the chest structure via the multi-stage adjustment for changing the volume of the resonance chamber. In the third embodiment, the plate can be moved inside the second part of the cover in the stepless manner, for changing the volume of the resonance chamber formed by the pyramid-shaped first part and the column-shaped second part. In the fourth embodiment, the plate can be moved inside the second part of the cover via the multi-stage adjustment, for changing the volume of the resonance chamber formed by the pyramid-shaped first part and the column-shaped second part. In the fifth embodiment, the acoustic deflecting module can replace one cover by another cover with different thickness for changing the volume of the resonance chamber. In the sixth embodiment, the acoustic deflecting module can adjust the aperture of the opening structure for changing the frequency of the audio signal. In the seventh embodiment, the acoustic deflecting module can include the plate having some masks with different radial dimensions, and the masks are matched with the pyramid-shaped first part for changing the volume of the resonance chamber.

These and other objectives of the present disclosure will no doubt become obvious to those of ordinary skill in the art after reading the following detailed description of the preferred embodiment that is illustrated in the various figures and drawings.

BRIEF DESCRIPTION OF THE DRAWINGS

FIG. 0.1 is a sectional view of a speaker device according to an embodiment of the present disclosure.

DETAILED DESCRIPTION

Figure 1:
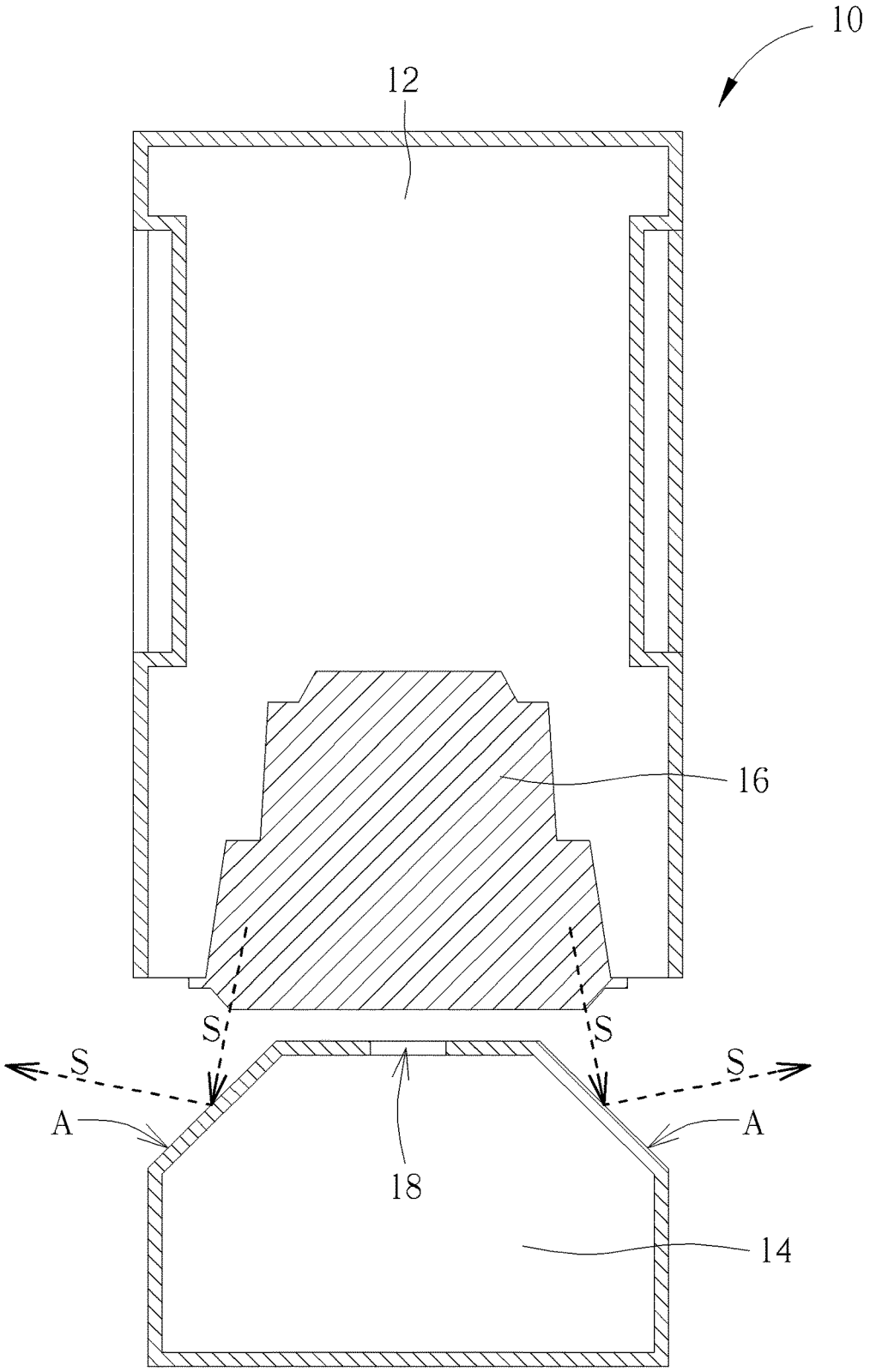

Please refer to FIG. 1. FIG. 1 is a sectional view of a speaker device 10 according to an embodiment of the present disclosure. The speaker device 10 can include a speaker chamber 12 and an acoustic deflecting module 14. An audio signal S generated by the speaker chamber 12 can be output outwardly via a transducer 16. The acoustic deflecting module 14 can be disposed adjacent to the speaker chamber 12, and the acoustic deflecting module 14 can have an opening structure 18. A position of the opening structure 18 may correspond to the transducer 16. An outer surface A of the acoustic deflecting module 14 can change a transmission direction of the audio signal S from the transducer 16. Thus, the acoustic deflecting module 14 can be defined as a resonance box of the speaker device 10. Some parameters, such as volume V of the acoustic deflecting module 14, a diameter D of the opening structure 18, a depth L of the opening structure 18 and speed of sound C, can be adjusted to vary a resonant frequency fV of the audio signal S for optimizing audio quality. The audio quality may include, but not be limited to, a tone, a frequency and a range of the audio signal S. Relation between the resonant frequency fV and the foresaid parameters can refer to a formula 1.

$$fV = \frac{C \times D}{4}\sqrt{\frac{1}{\pi \times V \times (L + 0.75D)}} \quad \text{Formula 1}$$

Figure 2:
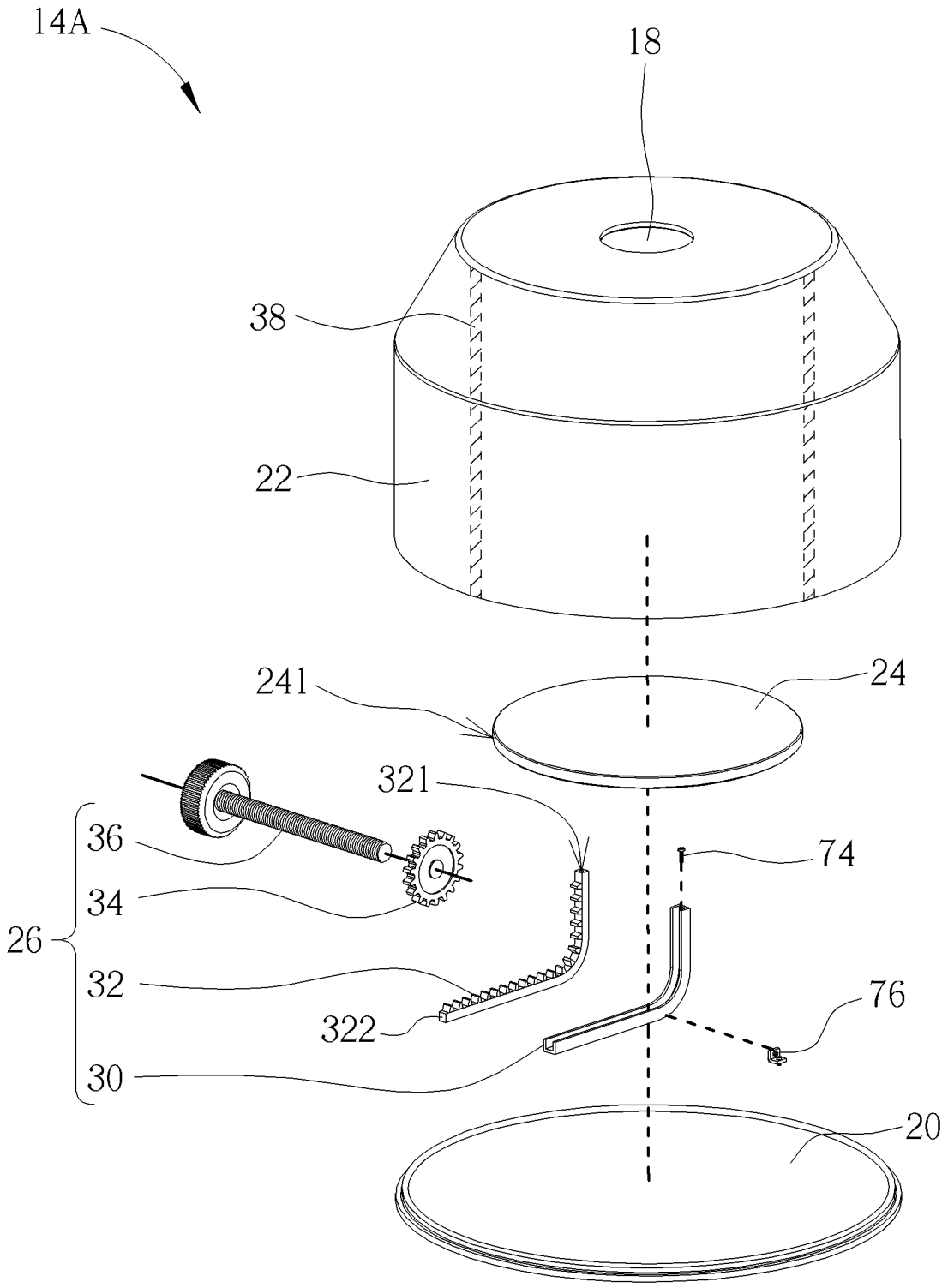
FIG. 2 is an exploded diagram of an acoustic deflecting module according to a first embodiment of the present disclosure.
Figure 3:
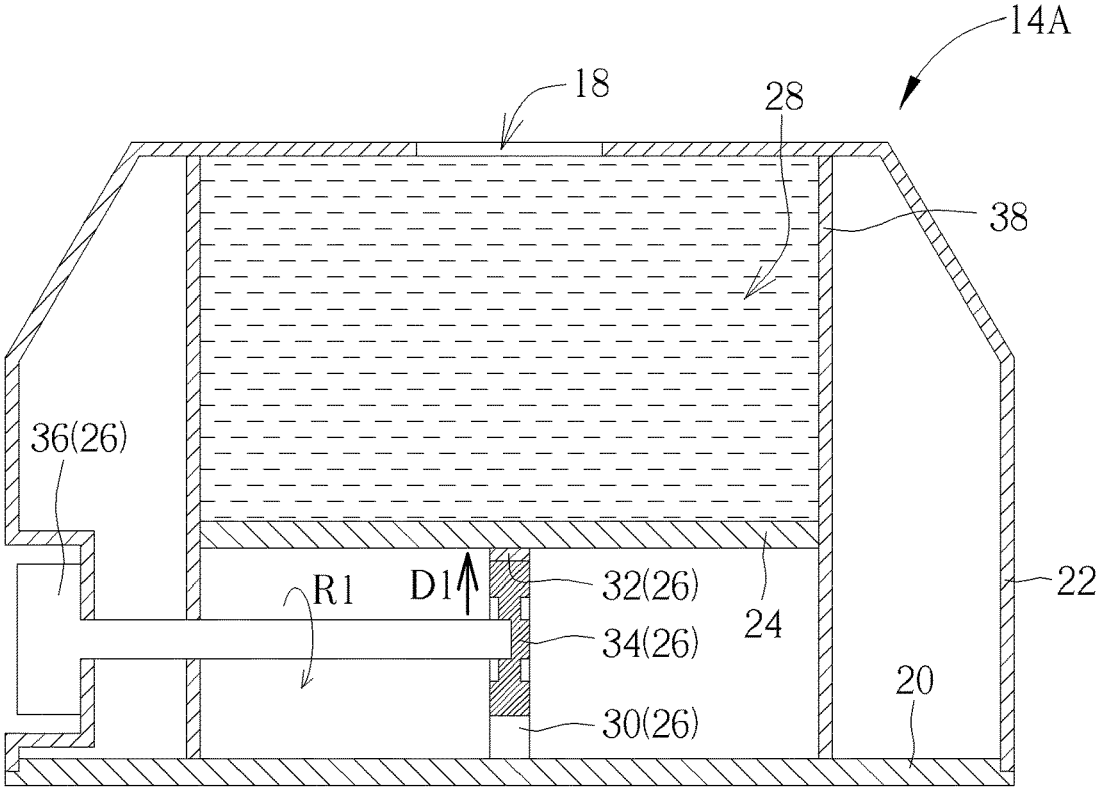
FIG. 3 to FIG. 5 are diagrams of the acoustic deflecting module in different operation modes according to the first embodiment of the present disclosure.
Figure 4:
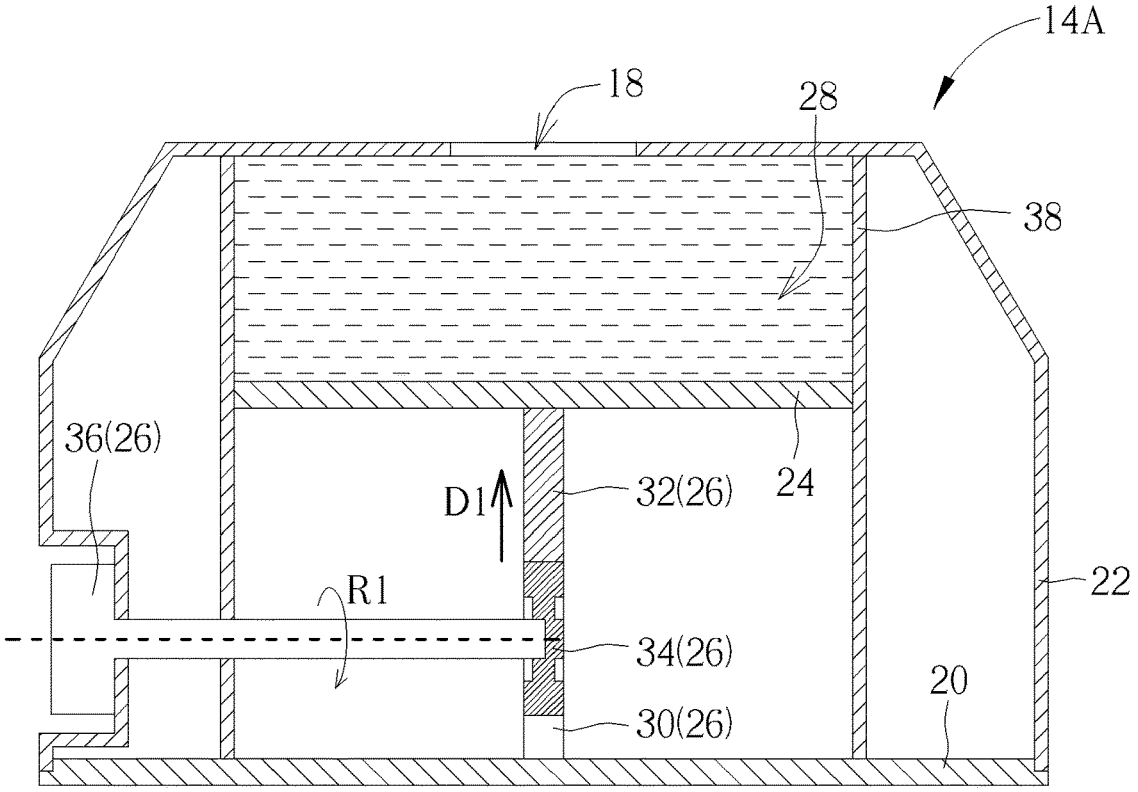
Figure 5:
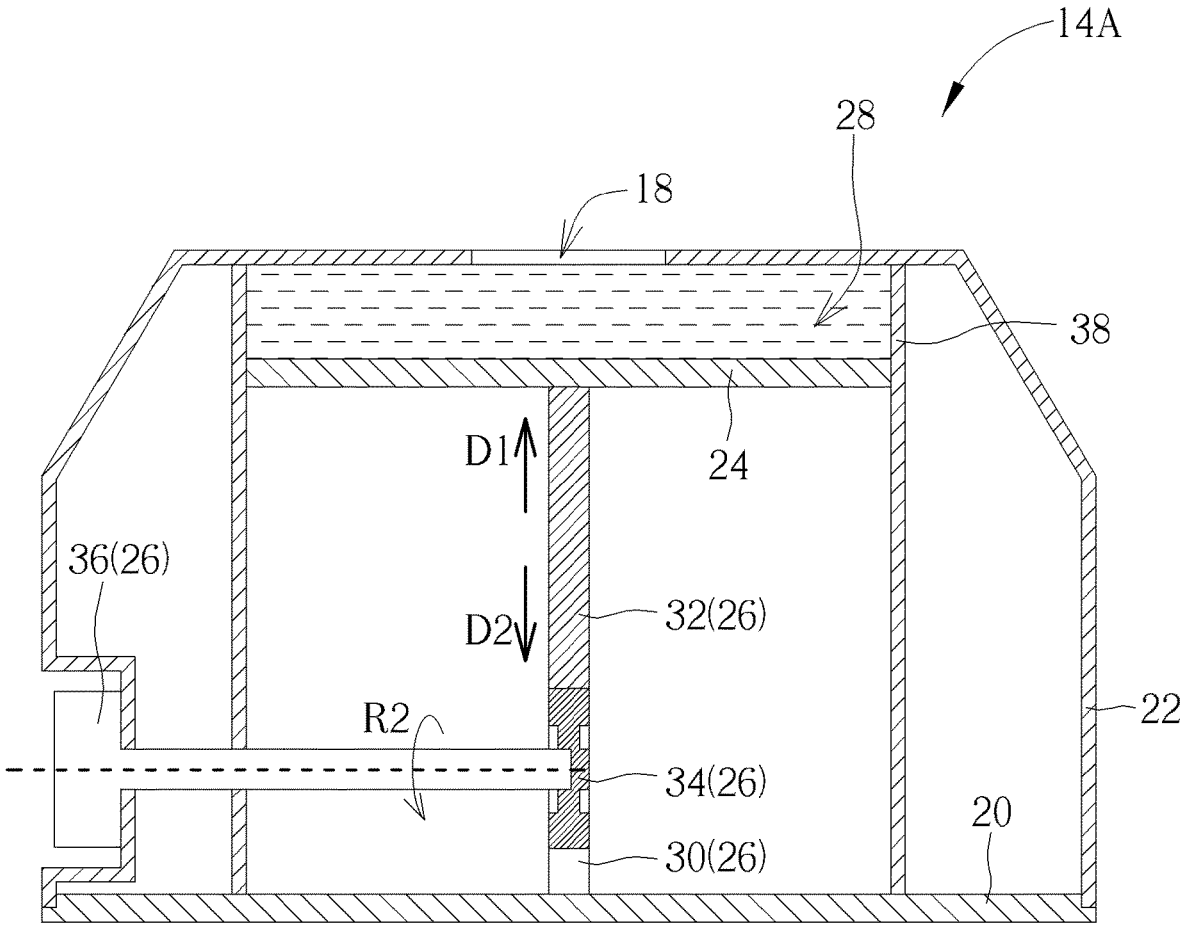

Please refer to FIG. 2 to FIG. 5. FIG. 2 is an exploded diagram of an acoustic deflecting module 14A according to a first embodiment of the present disclosure. FIG. 3 to FIG. 5 are diagrams of the acoustic deflecting module 14A in different operation modes according to the first embodiment of the present disclosure. The acoustic deflecting module 14A in the first embodiment can adjust the volume V of the resonance box to adjust the resonant frequency fV of the audio signal S. The acoustic deflecting module 14A can include a base 20, a cover 22, a plate 24 and a driving mechanism 26. The cover 22 and the base 20 can be assembled with each other for accommodating the plate 24 and the driving mechanism 26. The plate 24 can be movably disposed inside the cover 22 to form a resonance chamber 28. The resonance chamber 28 can be a chamber with adjustable volume set inside the resonance box. The driving mechanism 26 can be disposed on the cover 22 and connected to the plate 24, and adapted to move the plate 24 inside the resonance chamber 28. In response to a movement of the plate 24 inside the resonance chamber 28, the volume of the resonance chamber 28 formed by the plate 24 and the cover 22 can be varied accordingly.

The driving mechanism 26 can include a supporter 30, a first guiding component 32, a second guiding component 34 and an operating component 36. The supporter 30 can be disposed on the base 20 and connected to the plate 24 via fixing components 74 and 76. The first guiding component 32 can have a first end 321 and a second end 322 opposite to each other. The first end 321 can be fixed to the plate 24, and the second end 322 can be movably disposed on the supporter 30. The second guiding component 34 can be movably disposed between the first end 321 and the second end 322 of the first guiding component 32. A movement of the second guiding component 34 can shift the first guiding component 32 for changing related position between the first end 321 and the second end 322. The operating component 36 can be disposed on the cover 22 and connected to the second guiding component 34. The operating component 36 can be manually or automatically controlled for positive rotation and negative rotation. Movements of the operating component 36 along different rotary directions can shift the plate 24 along different linear directions, so as to enlarge or reduce the volume of the resonance chamber 28.

In the first embodiment, the cover 22 can have a chest structure 38. Any two sectional surfaces of the chest structure 38 which are parallel to each other can have the same sectional dimension, which means the chest structure 38 may be a hollow pillar. The chest structure 38 can be a hollow column when the plate 24 is a circular form; the chest structure 38 can be a rectangular hollow structure when the plate 24 is a rectangular form. An edge 241 of the plate 24 can movably abut against an inner wall of the chest structure 38. The chest structure 38 can be extend from the cover 22 to the base 20, and therefore the plate 24 in the first embodiment can provide a longer shifting stroke.

The supporter 30 can be a track. The first guiding component 32 and the second guiding component 34 respectively can be a rack and a gear. The supporter 30 can provide constraining space for a single-directional movement, so that the first guiding component 32 can be moved inside the supporter 30 in one specific direction. The second guiding component 34 (such as the gear) can be engaged with the first guiding component 32 (such as the rack), and rotation of the second guiding component 34 can move the first guiding component 32 inside the supporter 30. As shown in FIG. 3, the plate 24 is in a lower position, and the resonance chamber 28 formed by the plate 24 and the cover 22 can have large volume. As shown in FIG. 4 and FIG. 5, the operating component 36 can be rotated in a first rotary direction R1, and the second guiding component 34 can be accordingly rotated to move the first guiding component 32 toward the cover 22, and then move the plate 24 in a first linear direction D1 for reducing the volume of the resonance chamber 28.

If the operating component 36 is rotated in a second rotary direction R2 opposite to the first rotary direction R1, the plate 24 can be moved in a second linear direction D2 opposite to the first linear direction D1 via the first guiding component 32 and the second guiding component 34, and then the volume of the resonance chamber 28 can be enlarged, as a change from FIG. 5 to FIG. 4, or as a change from FIG. 4 to FIG. 3.

Figure 6:
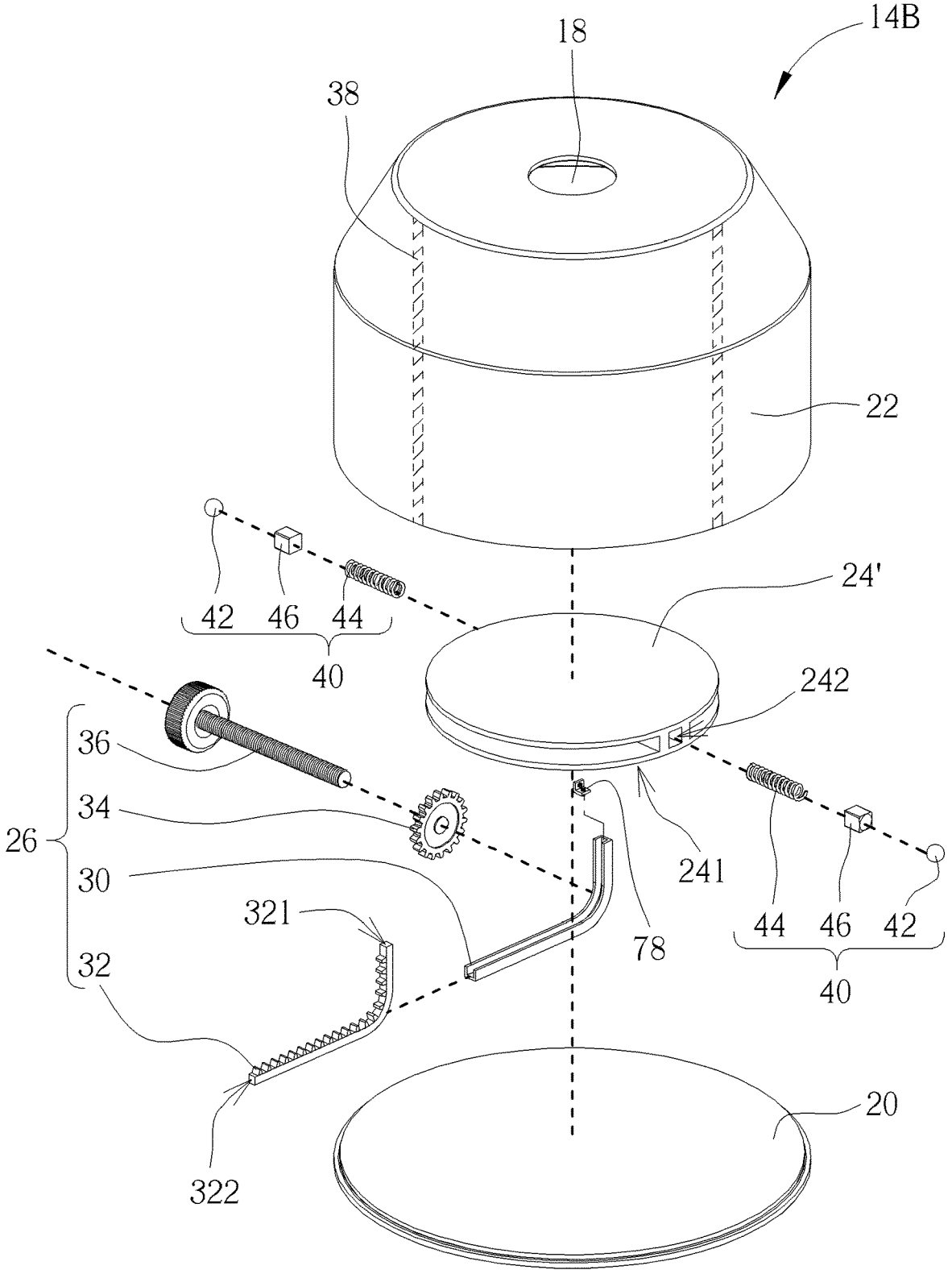
FIG. 6 is an exploded diagram of the acoustic deflecting module according to a second embodiment of the present disclosure.
Figure 7:
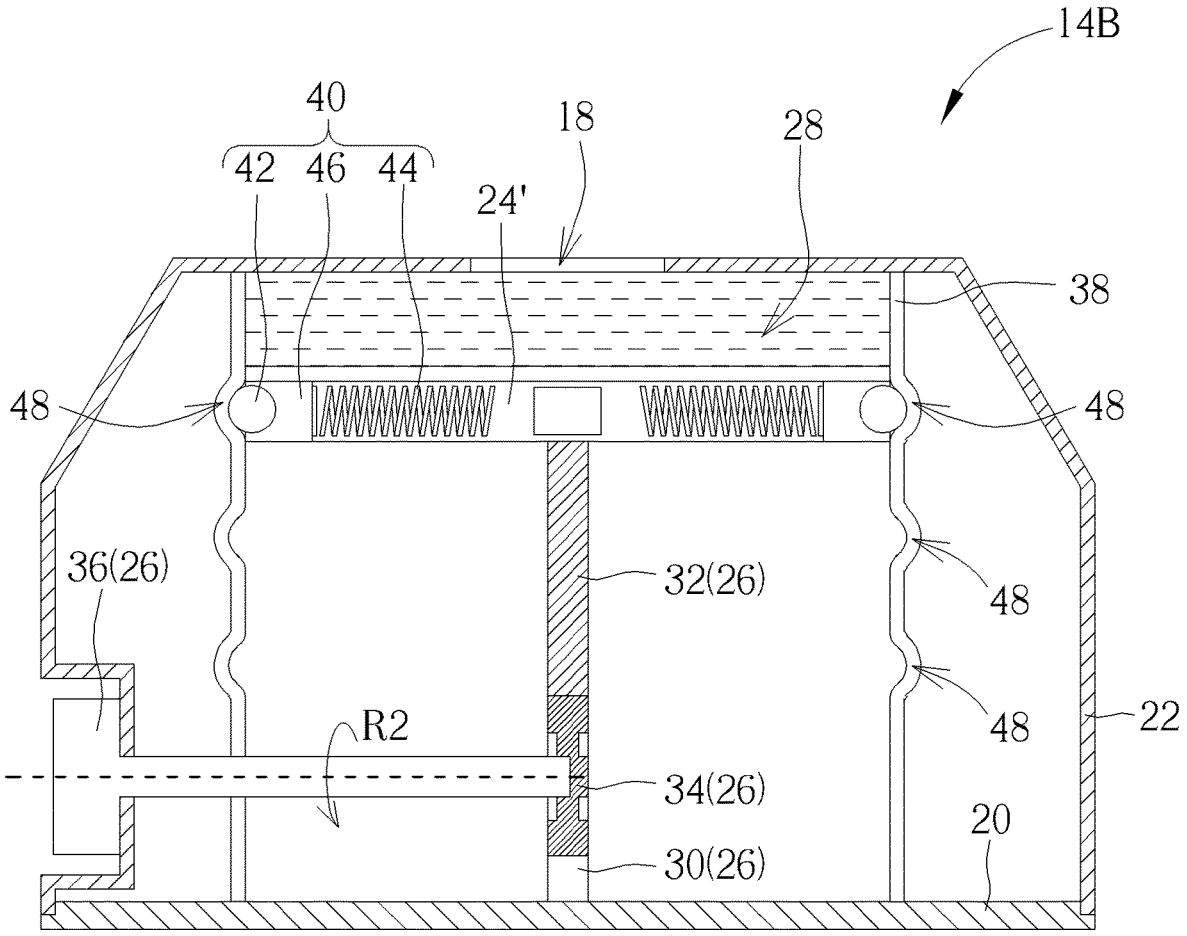
FIG. 7 is a sectional view of the acoustic deflecting module according to the second embodiment of the present disclosure.

Please refer to FIG. 6 and FIG. 7. FIG. 6 is an exploded diagram of an acoustic deflecting module 14B according to a second embodiment of the present disclosure. FIG. 7 is a sectional view of the acoustic deflecting module 14B according to the second embodiment of the present disclosure. In the second embodiment, elements having the same numeral as ones of the first embodiment have the same structures and functions, and a detailed description is omitted herein for simplicity. The acoustic deflecting module 14B in the second embodiment can adjust the volume V of the resonance box to change the resonant frequency fV of the audio signal S. Difference between the first embodiment and the second embodiment is that the plate 24' of the acoustic deflecting module 14B can have a specific thickness used to accommodate a positioning mechanism 40. The positioning mechanism 40 can restrict a movement of the plate 24' relative to the cover 22. Thus, the acoustic deflecting module 14A in the first embodiment can adjust the volume of the resonance chamber 28 in a stepless manner, and the acoustic deflecting module 14B in the second embodiment can adjust the volume of the resonance chamber 28 via multi-stage adjustment.

The supporter 30 can be disposed on the base 20 and/or connected to the plate 24' via a fixing component 78. The positioning mechanism 40 can include a positioning component 42, a resilient component 44 and a holding component 46. The positioning component 42 can be a roller installed inside the holding component 46. The resilient component 44 can be a compression spring installed inside an accommodating space 242 of the plate 24'. An end of the resilient component 44 can be connected to an inner wall of the accommodating space 242 inside the plate 24', and the other end of the resilient component 44 can be connected to the positioning component 42 via the holding component 46. The cover 22 can form several positioning slots 48 respectively on different positions of the chest structure 38. The positioning component 42 can abut against one of the positioning slots 48 in a detachable manner. As shown in FIG. 7, rotation of the operating component 36 can move the plate 24' relative to the chest structure 38 upward or downward via the first guiding component 32 and the second guiding component 34. When the plate 24' is moved, the positioning component 42 can be pressed to compress the resilient component 44 for departing from the positioning slot 48; the resilient component 44 is deformed to store a resilient recovering force. When the positioning component 42 is switched to another positioning slot 48, the resilient recovering force of the resilient component 44 can be released to push the positioning component 42 for engaging with the corresponding positioning slot 48. The volume of the resonance chamber 28 can be adjusted via the multi-stage adjustment.

Figure 8:
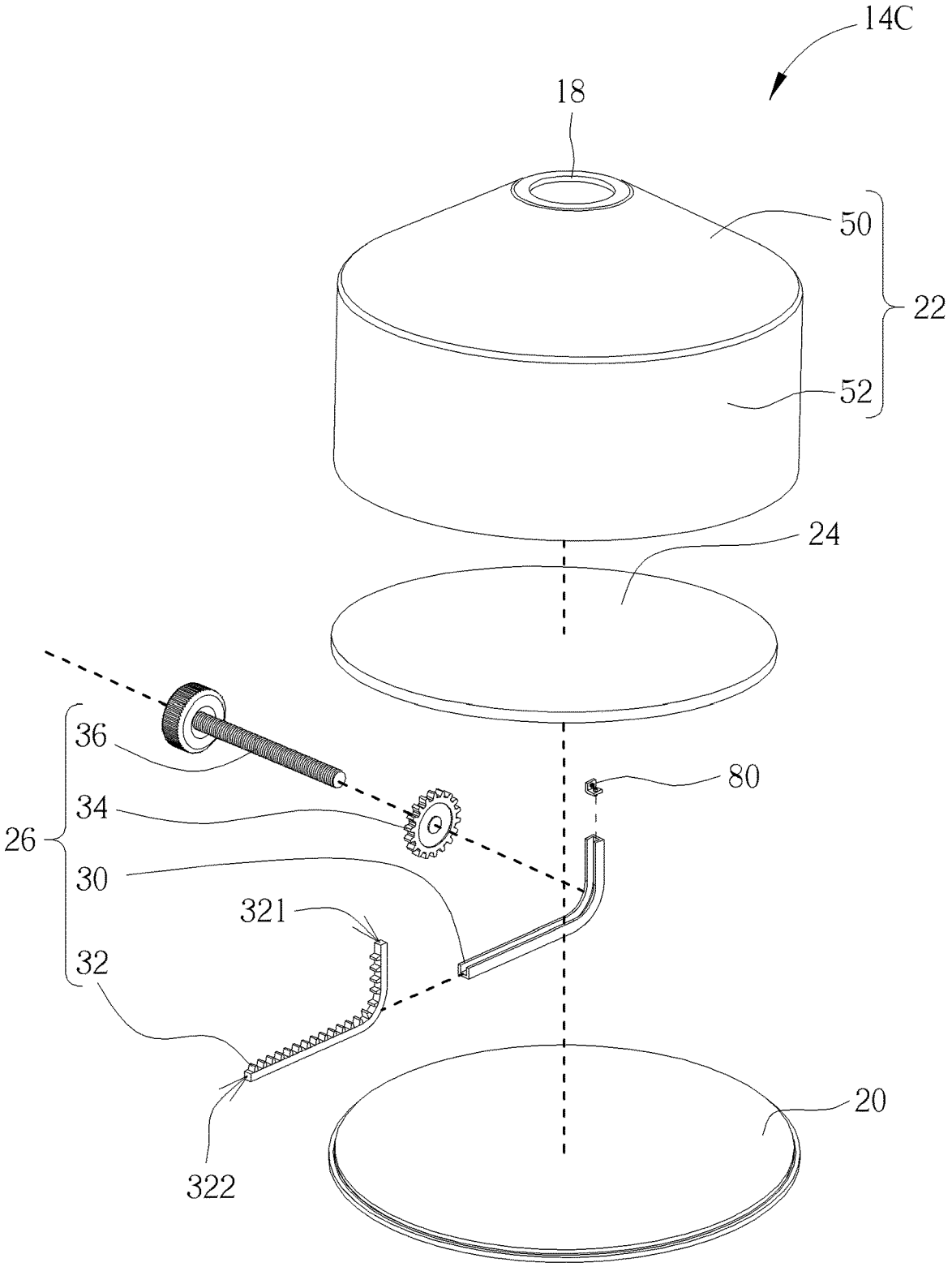
FIG. 8 is an exploded diagram of the acoustic deflecting module according to a third embodiment of the present disclosure.
Figure 9:
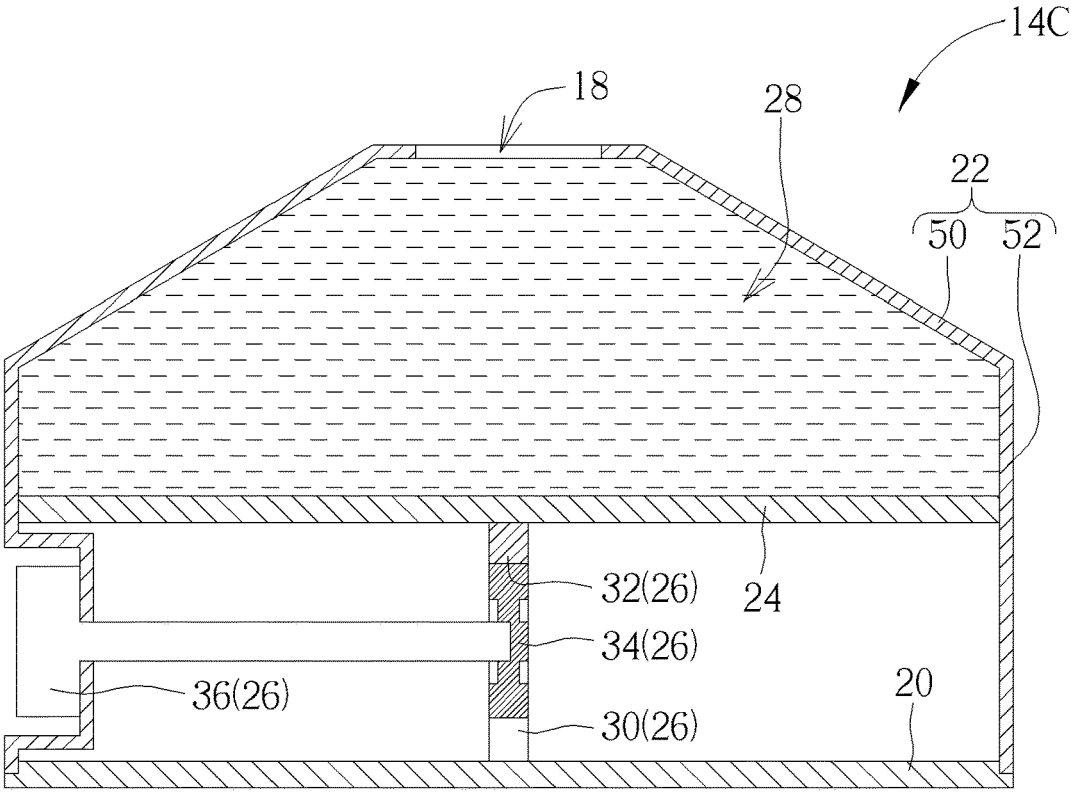
FIG. 9 to FIG. 11 are diagrams of the acoustic deflecting module in different operation modes according to the third embodiment of the present disclosure.
Figure 10:
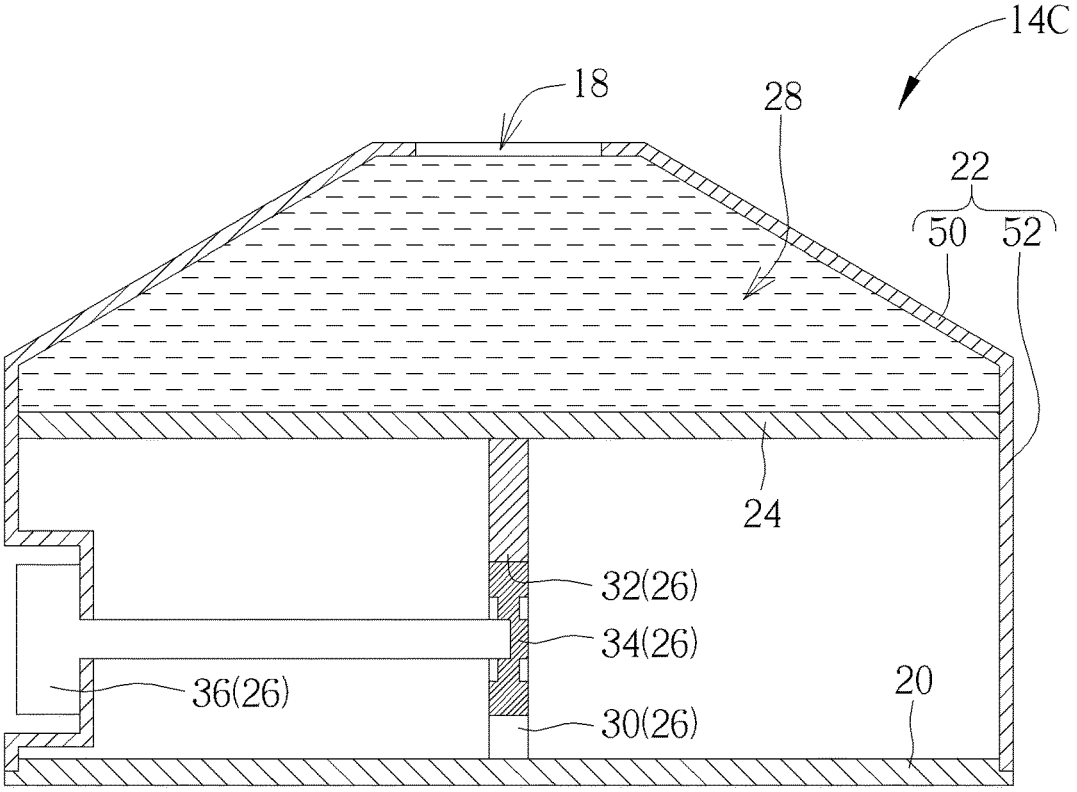
Figure 11:
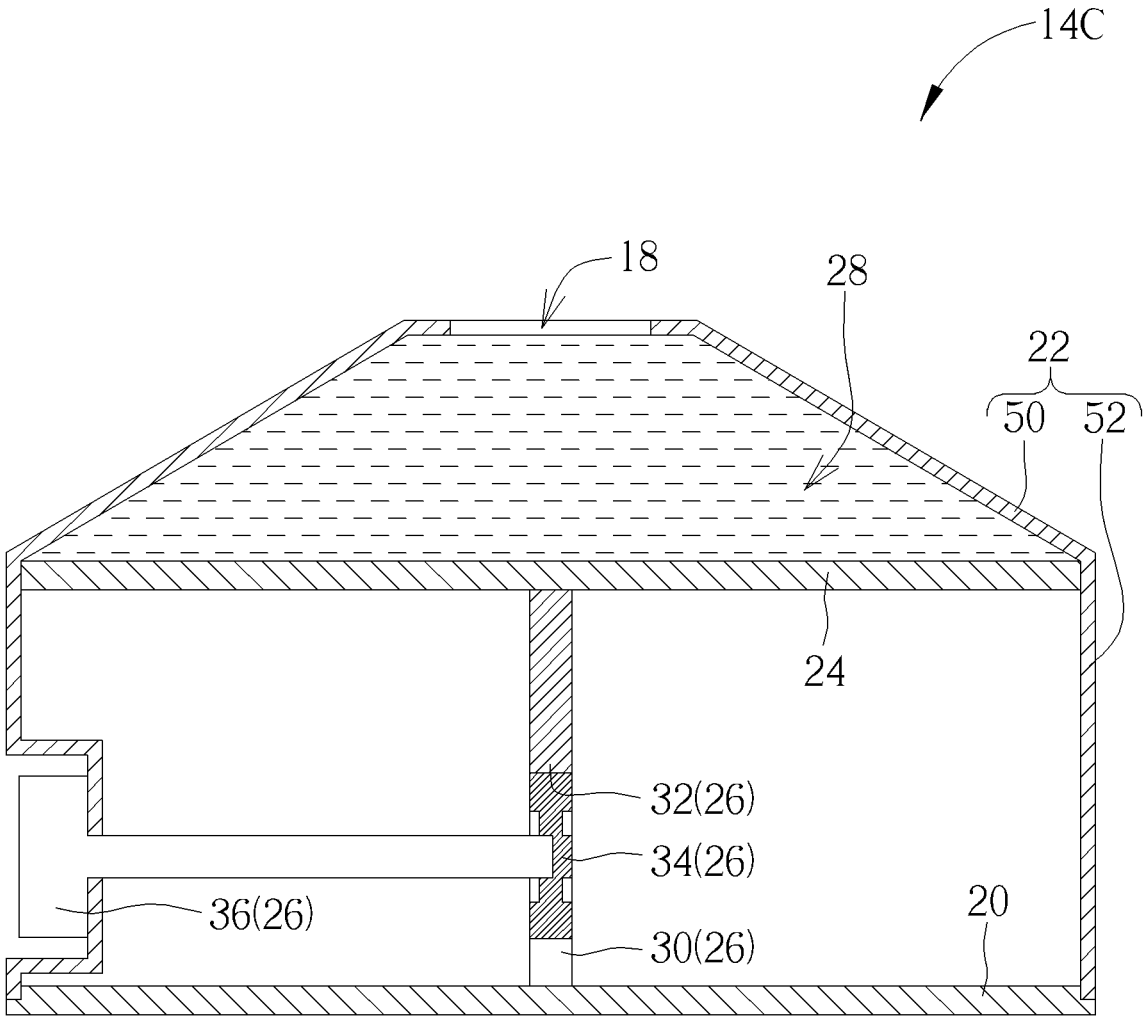

Please refer to FIG. 8 to FIG. 11. FIG. 8 is an exploded diagram of an acoustic deflecting module 14C according to a third embodiment of the present disclosure. FIG. 9 to FIG. 11 are diagrams of the acoustic deflecting module 14C in different operation modes according to the third embodiment of the present disclosure. In the third embodiment, elements having the same numeral as ones of the foresaid embodiments have the same structures and functions, and a detailed description is omitted herein for simplicity. The acoustic deflecting module 14C in the third embodiment can adjust the volume V of the resonance box to change the resonant frequency fV of the audio signal S. Difference between the third embodiment and the foresaid embodiments is that the cover 22 does not have the chest structure. The cover 22 of the acoustic deflecting module 14C can have a first part 50 and a second part 52. The first part 50 can be a pyramid structure, which means any two sectional surfaces of the first part 50 which are parallel to each other can have different sectional dimensions. The second part 52 can be a column structure, which means any two sectional surfaces of the second part 52 which are parallel to each other can have the same sectional dimension. In addition, the supporter 30 can be disposed on the base 20 and/or connected to the plate 24 via a fixing component 80.

The plate 24 of the acoustic deflecting module 14C can be movably disposed inside the second part 52 of the cover 22. The plate 24 does not enter the first part 50, and the driving mechanism 26 only moves the plate 24 inside the second part 52. As shown in FIG. 9, the plate 24 is in the lower position inside the second part 52, so the resonance chamber 28 can have large volume. As shown in FIG. 10, if the driving mechanism 26 moves the plate 24 upwardly for being close to a position between the first part 50 and the second part 52, the volume of the resonance chamber 28 can be reduced accordingly. As shown in FIG. 11, the driving mechanism 26 can further move the plate 24 upwardly to be the position between the first part 50 and the second part 52, so that the volume of the resonance chamber 28 can be reduced to a minimal situation. Reverse operation of the driving mechanism 26 by lowering the plate 24 can enlarge the volume of the resonance chamber 28, so as to recover the acoustic deflecting module 14C to an initial mode.

Figure 12:
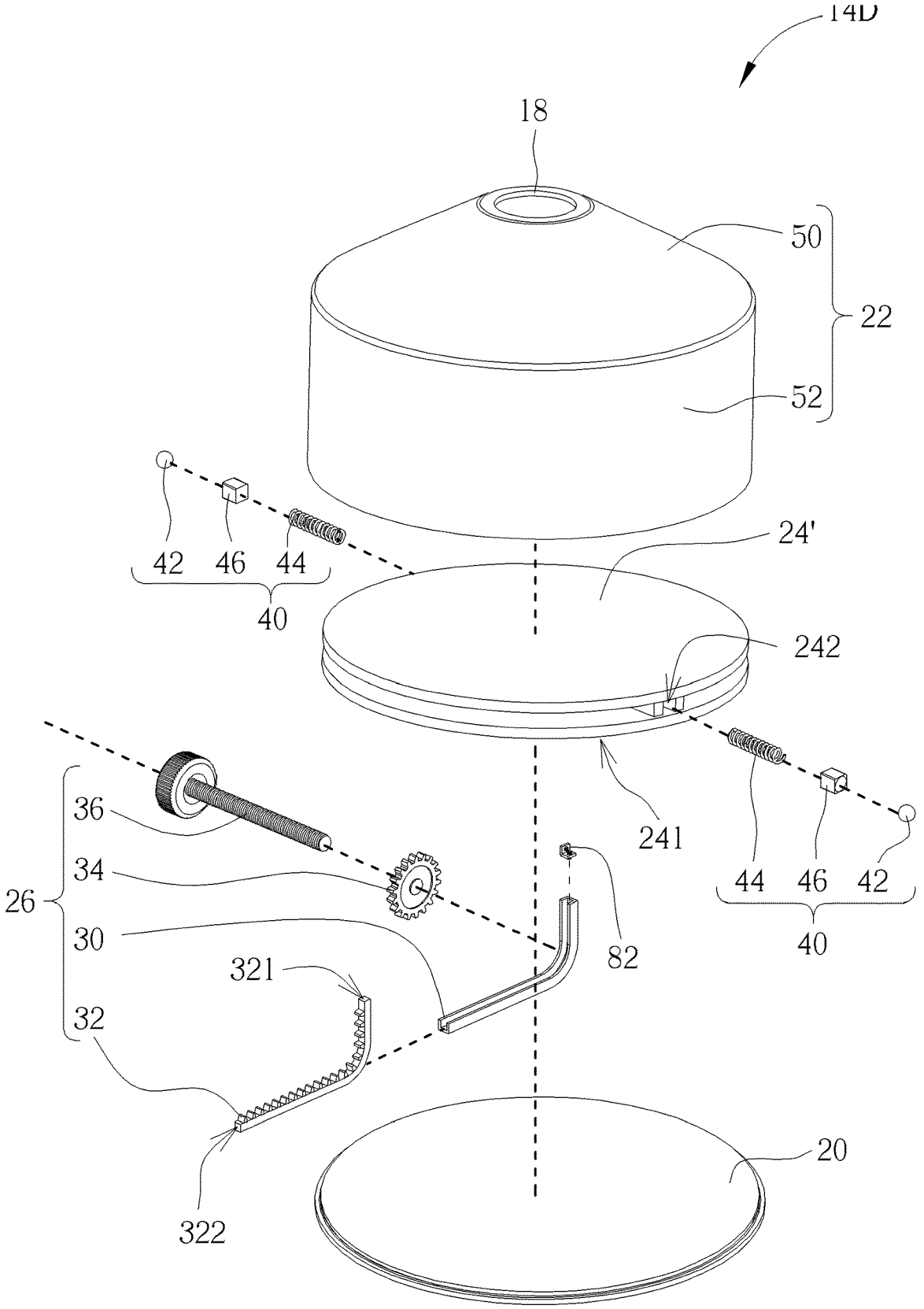
FIG. 12 is an exploded diagram of the acoustic deflecting module according to a fourth embodiment of the present disclosure.
Figure 13:
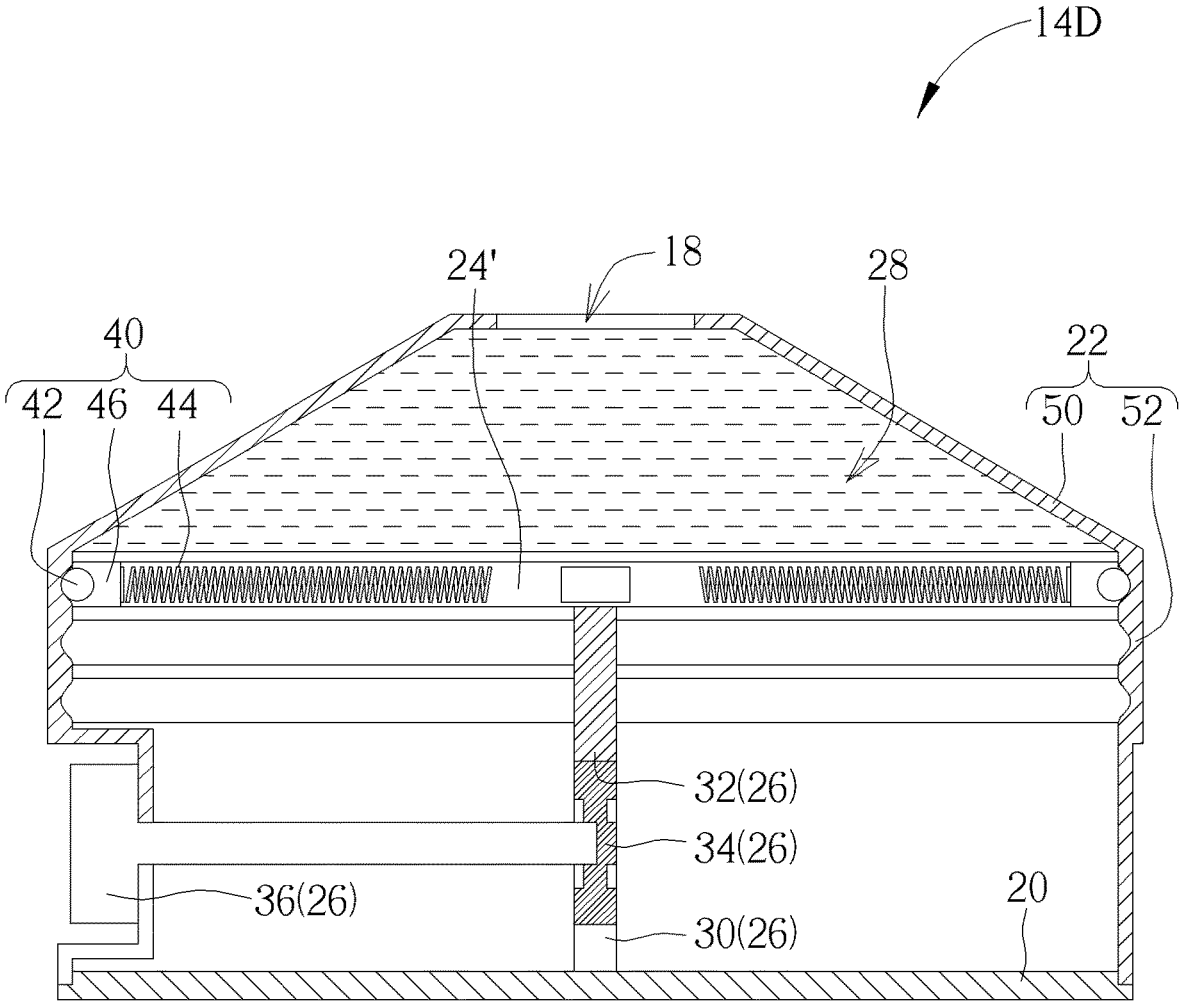
FIG. 13 is a sectional view of the acoustic deflecting module according to the fourth embodiment of the present disclosure.

Please refer to FIG. 12 and FIG. 13. FIG. 12 is an exploded diagram of an acoustic deflecting module 14D according to a fourth embodiment of the present disclosure. FIG. 13 is a sectional view of the acoustic deflecting module 14D according to the fourth embodiment of the present disclosure. In the fourth embodiment, elements having the same numeral as ones of the foresaid embodiments have the same structures and functions, and a detailed description is omitted herein for simplicity. The acoustic deflecting module 14D in the fourth embodiment can adjust the volume V of the resonance box to change the resonant frequency fV of the audio signal S. Difference between the fourth embodiment and the foresaid embodiments is that the plate 24' of the acoustic deflecting module 14D can have the accommodating space 242 used to accommodate the positioning mechanism 40. The acoustic deflecting module 14D can utilize the positioning mechanism 40 to move the plate 24' via the multi-stage adjustment for changing the volume of the resonance chamber 28. The supporter 30 can be disposed on the base 20 and/or connected to the plate 24' via a fixing component 82.

Figure 14:
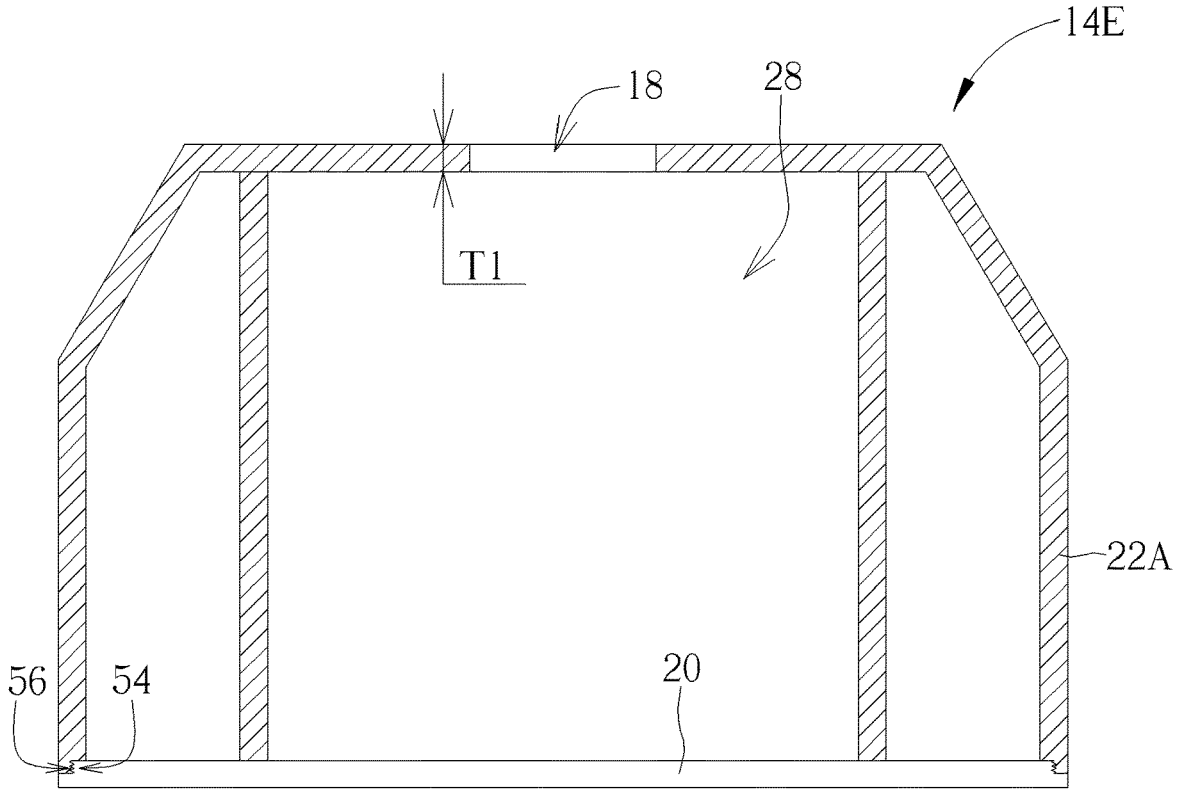
FIG. 14 and FIG. 15 are sectional views of the acoustic deflecting module in different operation modes according to a fifth embodiment of the present disclosure.
Figure 15:
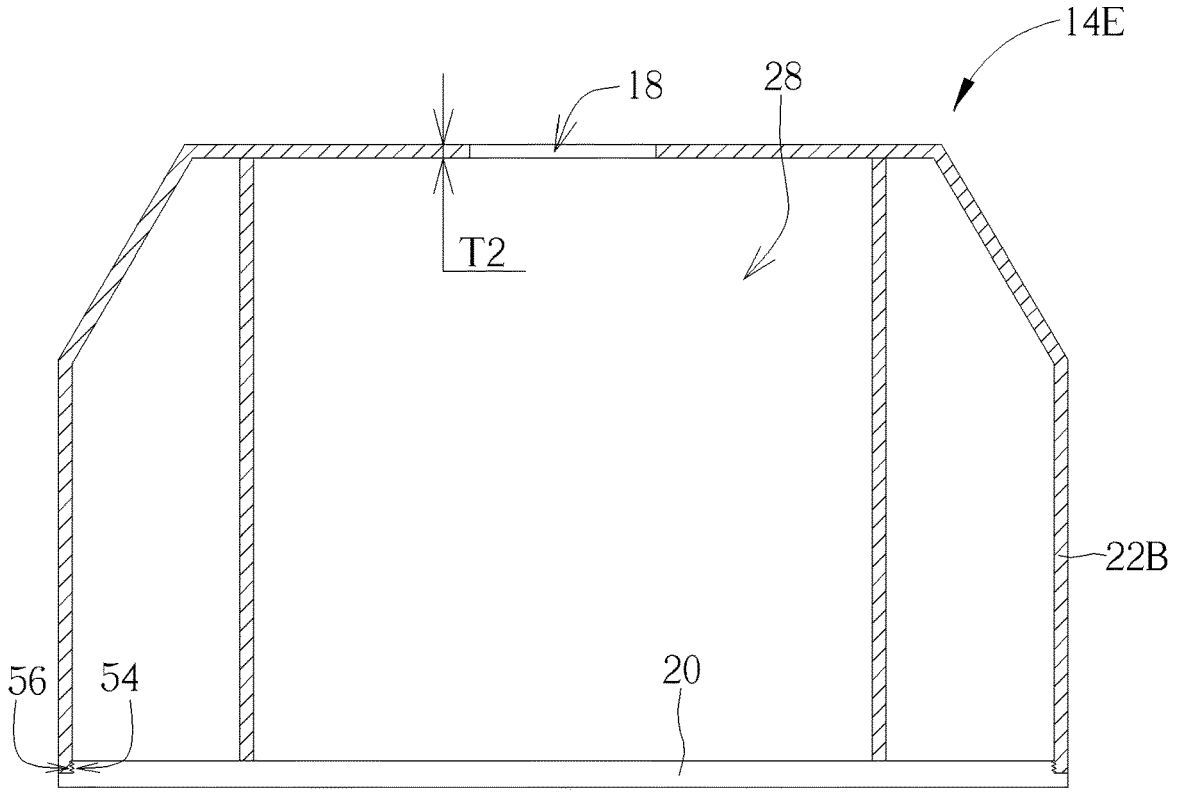

Please refer to FIG. 14 and FIG. 15. FIG. 14 and FIG. 15 are sectional views of an acoustic deflecting module 14E in different operation modes according to a fifth embodiment of the present disclosure. The acoustic deflecting module 14E in the fifth embodiment can adjust a depth L of the opening structure 18 to change the resonant frequency fV of the audio signal S. The acoustic deflecting module 14E can include the base 20 and two covers 22A and 22B. One of the covers 22A and 22B can be used to assemble with the base 20 for forming the resonance chamber 28. A thickness T1 of the cover 22A is different from a thickness T2 of the cover 22B. The thickness T1 and the thickness T2 can represent the depth L of the opening structure 18. The base 20 can have a first jointing structure 54; the covers 22A and 22B can respectively have a second jointing structure 56, which corresponds to the first jointing structure 54. The first jointing structure 54 and the second jointing structure 56 can be two screw structures capable of being engaged with each other. A user can assemble one of the covers 22A and 22B with the base 20 in the detachable manner for manually changing the depth L of the opening structure 18 on the resonance box, so as to adjust the audio quality of the speaker device 10.

Figure 16:
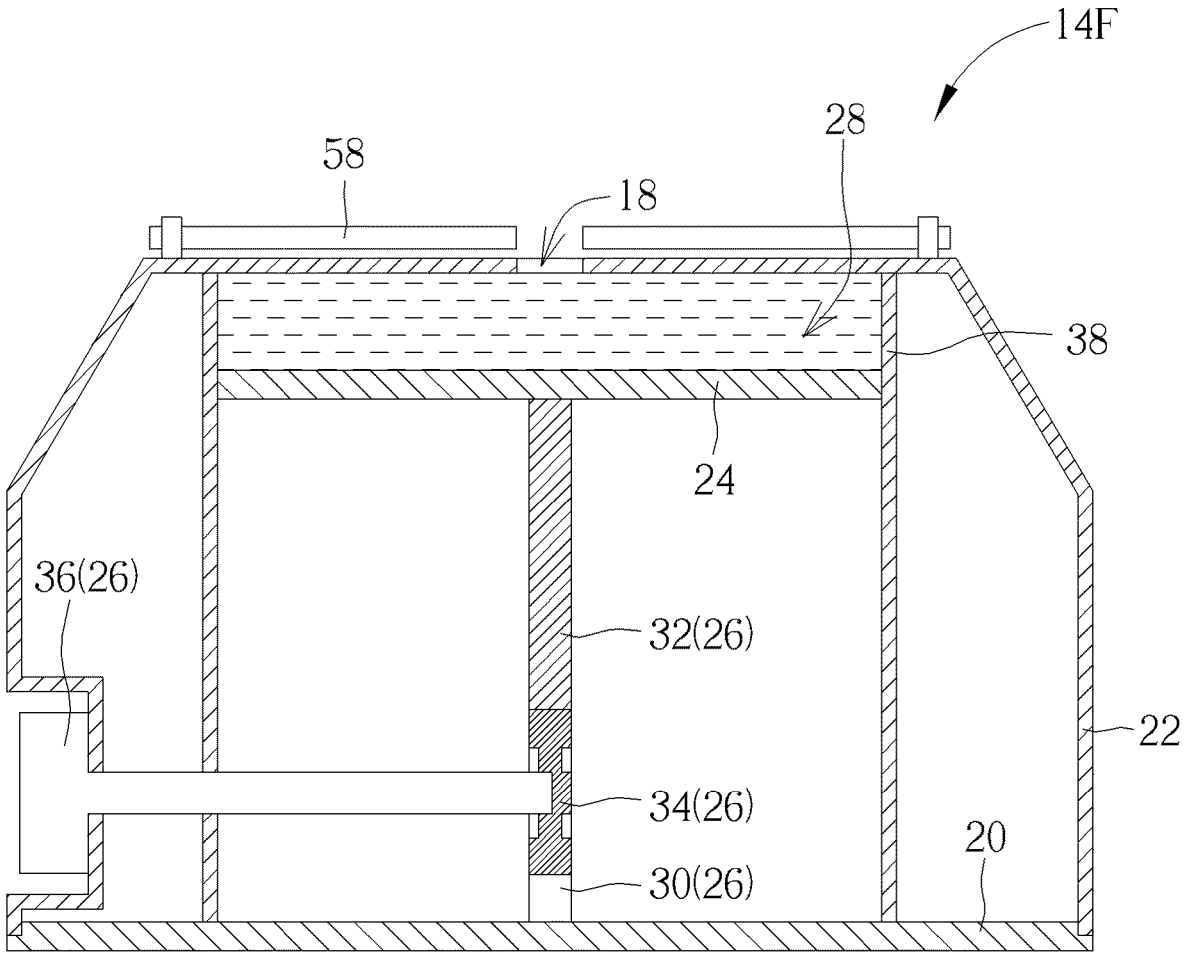
FIG. 16 is a sectional view of the acoustic deflecting module according to a sixth embodiment of the present disclosure.
Figure 17:
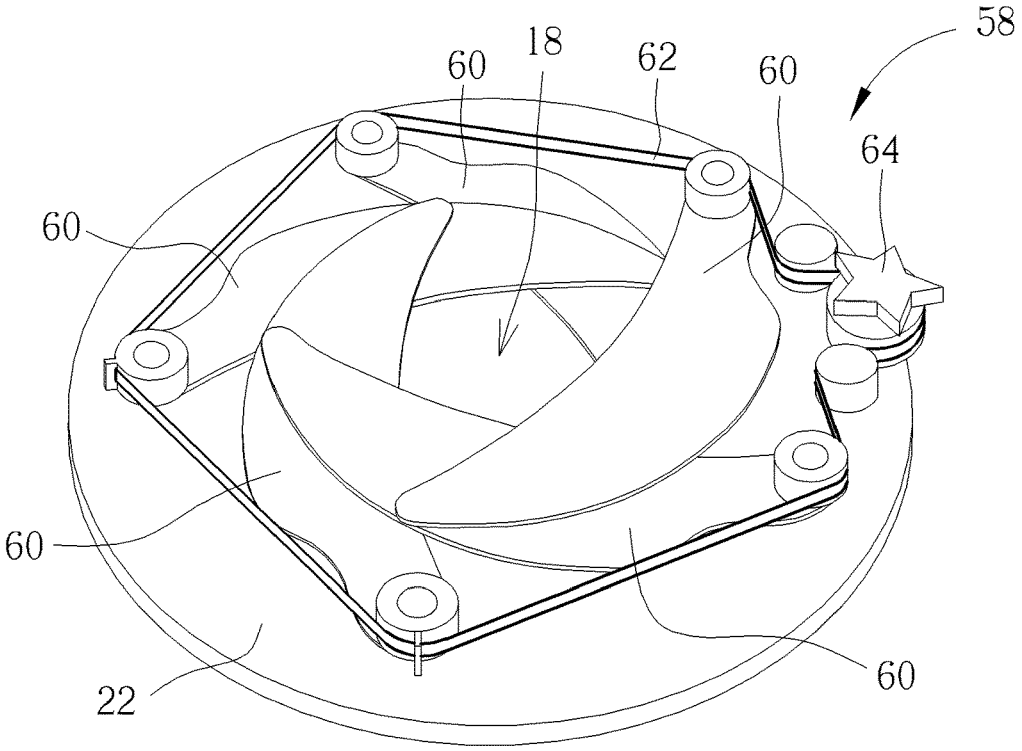
FIG. 17 and FIG. 18 are diagrams of a sheltering mechanism in different operation modes according to the sixth embodiment of the present disclosure.
Figure 18:
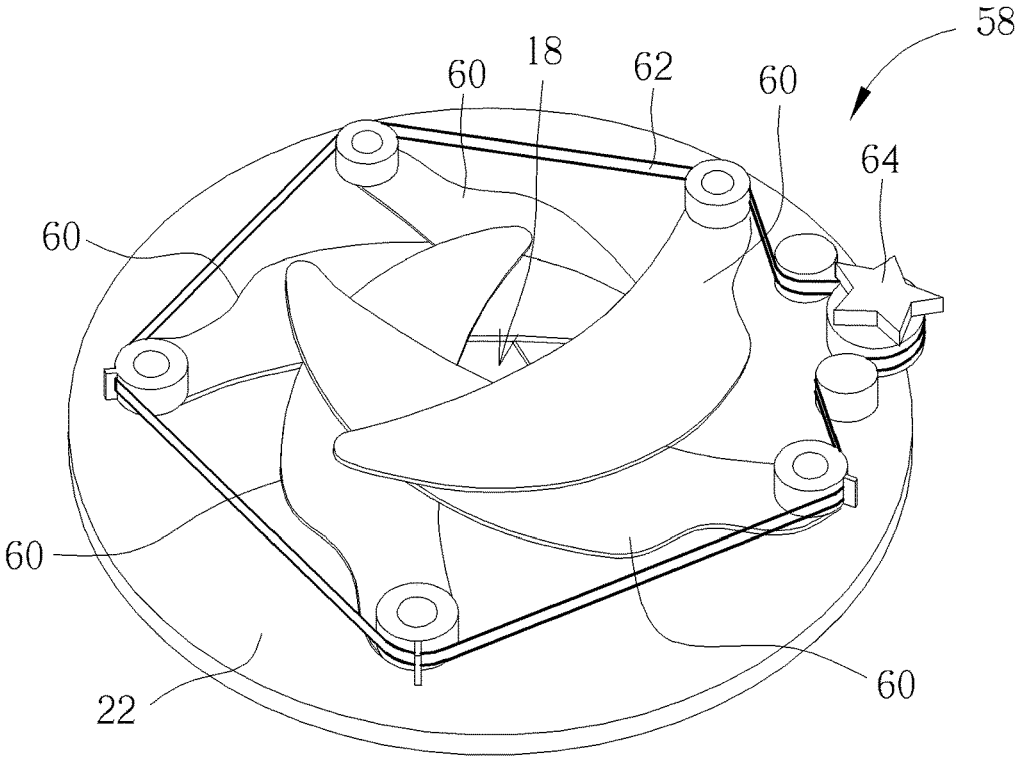

Please refer to FIG. 16 to FIG. 18. FIG. 16 is a sectional view of an acoustic deflecting module 14F according to a sixth embodiment of the present disclosure. FIG. 17 and FIG. 18 are diagrams of a sheltering mechanism 58 in different operation modes according to the sixth embodiment of the present disclosure. The acoustic deflecting module 14F in the sixth embodiment can adjust an aperture D of the opening structure 18 to change the resonant frequency fV of the audio signal S. The acoustic deflecting module 14F can include the sheltering mechanism 58 disposed on the cover 22 and used to shelter the opening structure 18 in a switchable manner. Mechanical design of the sheltering mechanism 58 is not limited to this embodiment, which depends on design demand. It should be mentioned that the acoustic deflecting module 14F in the sixth embodiment not only can utilize the driving mechanism 26 and the sheltering mechanism 58 to respectively adjust the volume of the resonance chamber 28 and the aperture D of the opening structure 18, but also can only adjust the aperture D of the opening structure 18 for changing the resonant frequency fV of the audio signal S through a removal of the plate 24 and the driving mechanism 26.

The sheltering mechanism 58 can include at least one sheltering component 60, a bridging component 62 and a controlling component 64. An amount of the sheltering component 60 can be a plural number. A plurality of sheltering components 60 can be movably disposed on the cover 22 in a partly overlapped manner. Each sheltering component 60 can be assembled with the cover 22 via an axle. The bridging component 62 can be connected to the plurality of sheltering components 60 via all the axles. Generally, the sheltering component 60 may dispose a gear on its axle, and the bridging component 62 can be a gear belt or a rack engaged with the gear disposed on the axle of the sheltering component 60. The controlling component 64 can be movably disposed on the cover 22 and connected to the bridging component 62. The controlling component 64 can be operated for driving the bridging component 62 to simultaneously actuate the plurality of sheltering components 60. For example, the controlling component 64 can be a rotary button, and the rotary button can be rotated by the user to pull the bridging component 62, so the bridging component 62 can simultaneously rotate the plurality of sheltering components 60 via engagement of the gear and the rack for sheltering or exposing the opening structure 18.

Figure 19:
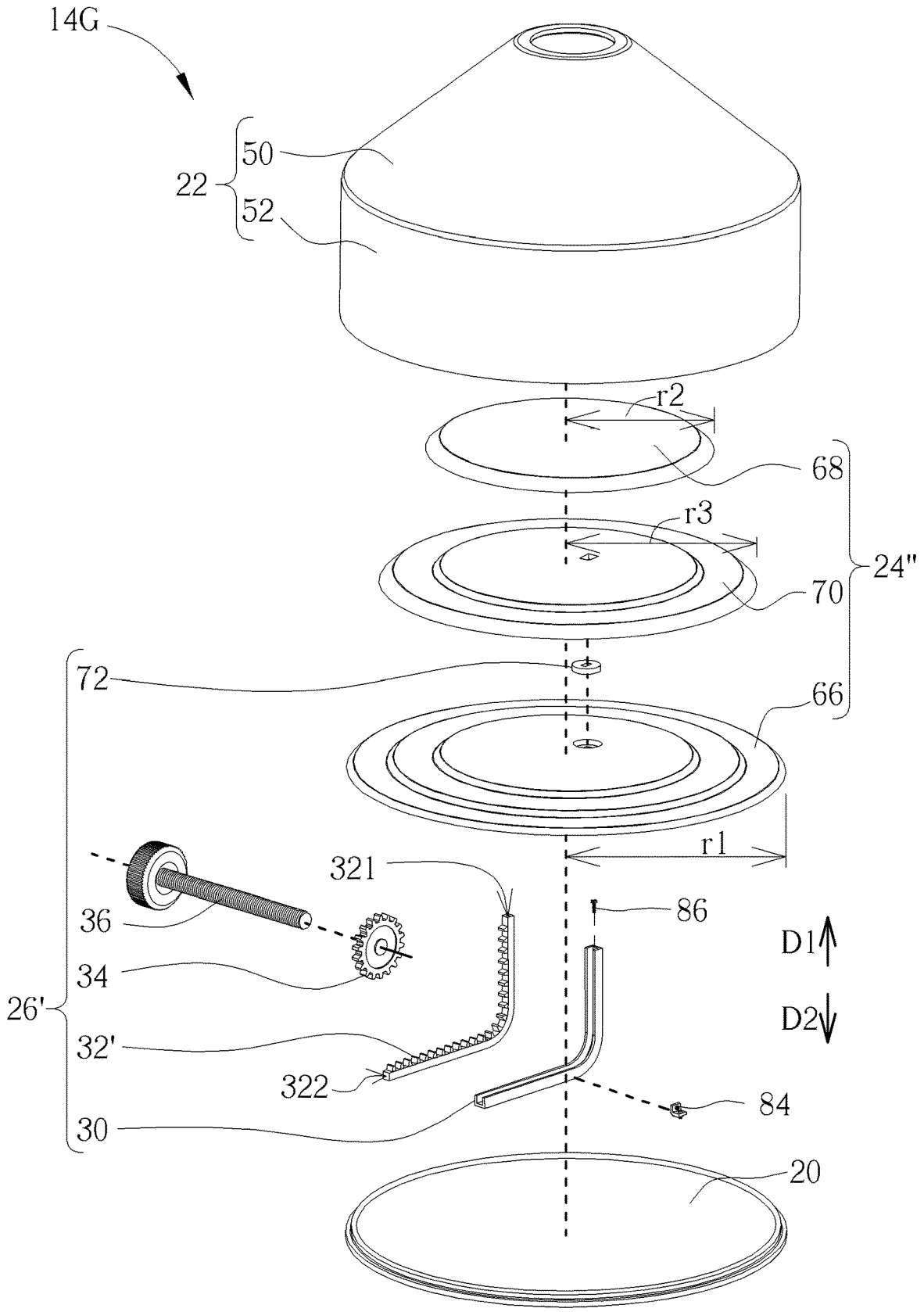
FIG. 19 is an exploded diagram of the acoustic deflecting module according to a seventh embodiment of the present disclosure.
Figure 20:
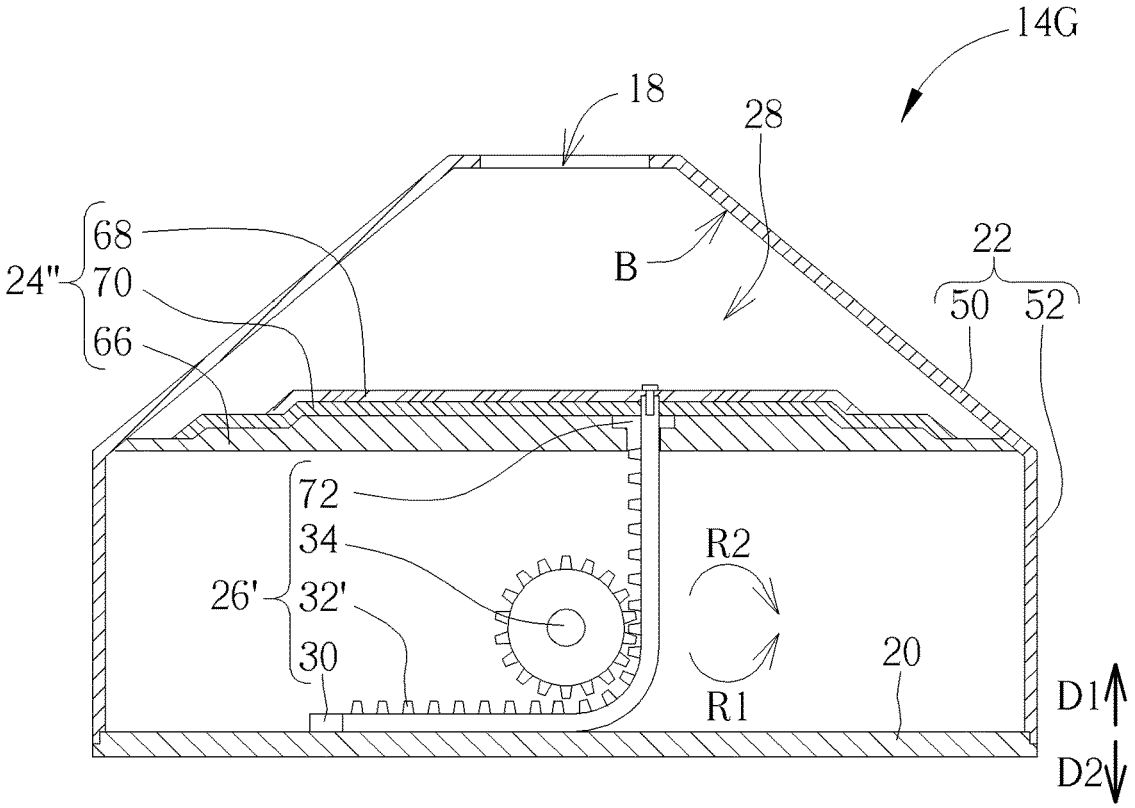
FIG. 20 to FIG. 22 are diagrams of the acoustic deflecting module in different operation modes according to the seventh embodiment of the present disclosure.
Figure 21:
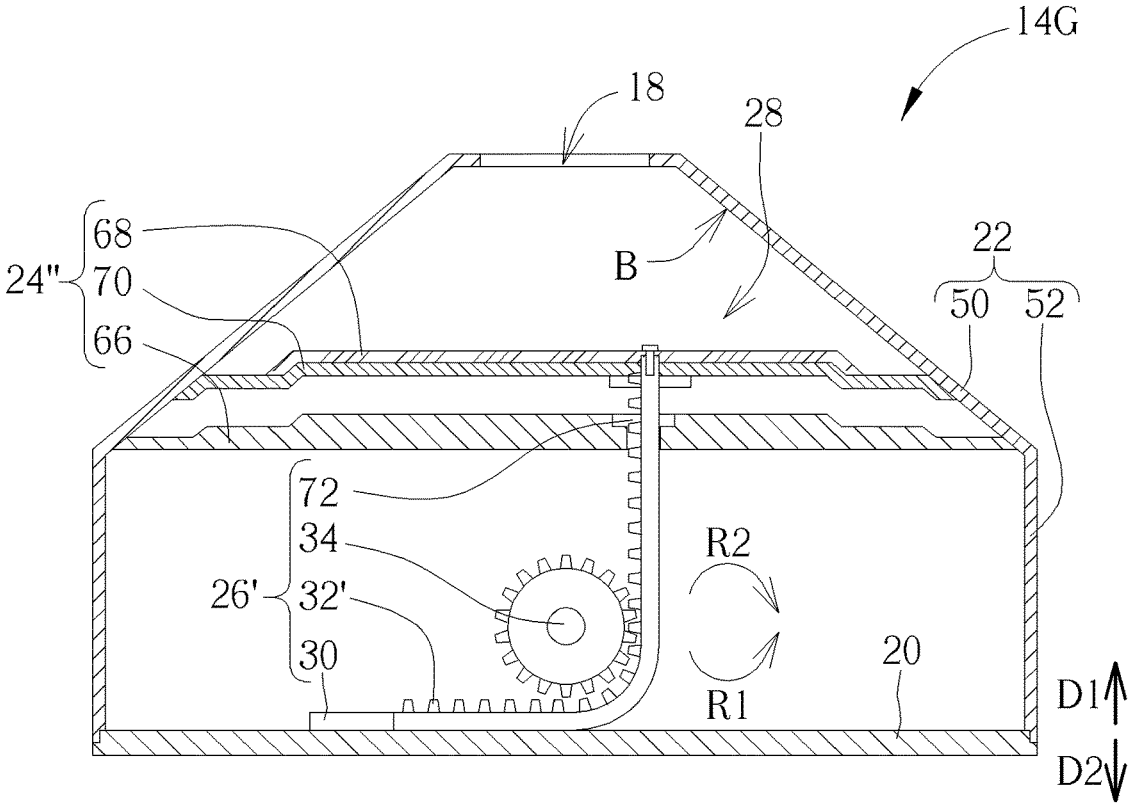
Figure 22:
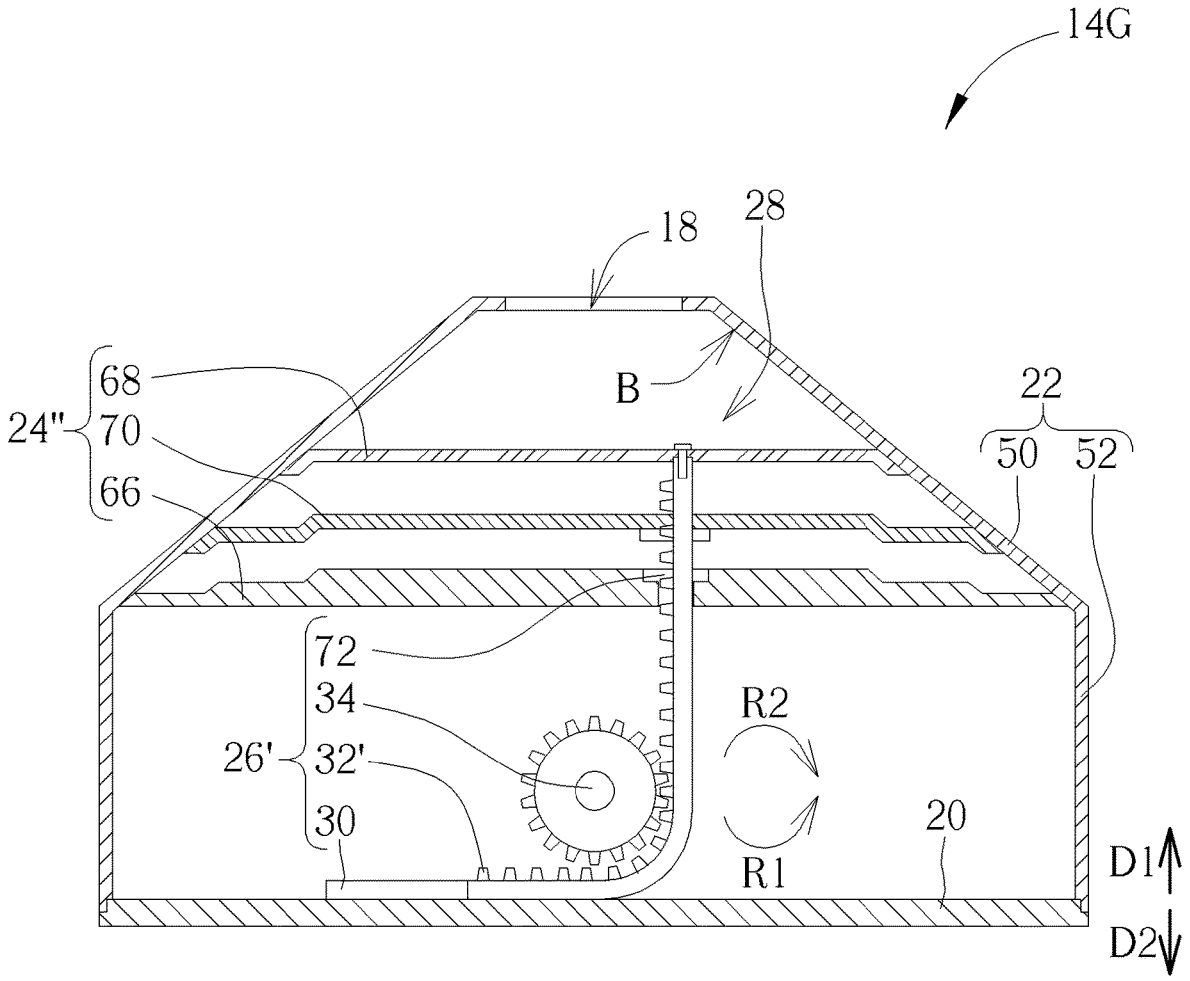

Please refer to FIG. 19 to FIG. 22. FIG. 19 is an exploded diagram of an acoustic deflecting module 14G according to a seventh embodiment of the present disclosure. FIG. 20 to FIG. 22 are diagrams of the acoustic deflecting module 14G in different operation modes according to the seventh embodiment of the present disclosure. In the seventh embodiment, elements having the same numeral as ones of the foresaid embodiments have the same structures and functions, and a detailed description is omitted herein for simplicity. The acoustic deflecting module 14G in the seventh embodiment can adjust the volume V of the resonance box to change the resonant frequency fV of the audio signal S. Difference between the seventh embodiment and the foresaid embodiments is that the plate 24" of the acoustic deflecting module 14G can include several masks disposed on the first part 50 of the cover 22 and respectively having different radial dimensions. The driving mechanism 26' may move one or some of the several masks for reducing and enlarging the volume of the chamber 28. The supporter 30 can be disposed on the base 20 and connected to the plate 24" via fixing components 84 and 86.

In this embodiment, the plate 24" may include a first mask 66, a second mask 68 and a third mask 70; however, an amount of the mask is not limited to the above-mentioned embodiment, and depends on design demand. A radial dimension r1 of the first mask 66 can be greater than a radial dimension r2 of the second mask 68 and a radial dimension r3 of the third mask 70. The radial dimension r2 of the second mask 68 can be smaller than the radial dimension r3 of the third mask 70. In addition, the radial dimension r2 of the second mask 68 can be greater than one sectional surface of the first part 50 which has the smallest sectional dimension. The first mask 66, the second mask 68 and the third mask 70 can abut against an inner wall B of the cover 22 via its edges for respectively forming some resonance chambers 28 with different volume. The first mask 66 can be fixed inside the cover 22 and located on a position closest to the driving mechanism 26'. The second mask 68 and the third mask 70 can be movably disposed on the first part 50, and the third mask 70 can be located between the first mask 66 and the second mask 68.

The driving mechanism 26' can include the supporter 30, the first guiding component 32', the second guiding component 34, the operating component 36 and a constraining component 72. The first end 321 of the first guiding component 32' can sequentially pass through the first mask 66 and the third mask 70 in a movable manner for fixing onto the second mask 68. The second end 322 of the first guiding component 32' can be movably disposed on the supporter 30. The constraining component 72 can be a block movably disposed on the first guiding component 32' and located between the first mask 66 and the third mask 70. The operating component 36 can provide several kinds of movements to actuate the driving mechanism 26' for moving the second mask 68 and the third mask 70 close to or far from the first mask 66 via the constraining component 72, so that the volume of the resonance chamber 28 can be enlarged and reduced accordingly. For example, the second mask 68 and the third mask 70 may be simultaneously moved in the first linear direction D1, and the second mask 68 may be moved relative to the third mask 70 or moved simultaneously with the third mask 70 when the second mask 68 is moved in the second linear direction D2.

As shown in FIG. 20, the first mask 66, the second mask 68 and the third mask 70 are kept near to each other in the lowest position, and the volume of the resonance chamber 28 can be formed by the first mask 66 and the cover 22. A first movement of the operating component 36 can be rotated in the first rotary direction R1, and the first guiding component 32' can be pushed upwardly by the second guiding component 34 along the supporter 30; meanwhile, the third mask 70 is held by the constraining component 72 to push the second mask 68 in the first linear direction D1 for departing from the first mask 66. As shown in FIG. 21, the volume of the resonance chamber 28 can be reduced when the edge of the third mask 70 abuts against the inner wall B of the cover 22. Then, a second movement of the operating component 36 can be further rotated in the first rotary direction R1, and the first guiding component 32' may protrude from the constraining component 72 to push the second mask 68 in the first linear direction D1 for departing from the third mask 70. As shown in FIG. 22, the volume of the resonance chamber 28 can be further reduced when the edge of the second mask 68 abuts against the inner wall B of the cover 22. Thus, the second movement can be greater than the first movement.

Moreover, the operating component 36 can be rotated in the second rotary direction R2 to execute a third movement, and the second guiding component 34 can move the first guiding component 32' downwardly along the supporter 30. The second mask 68 may be lowered in response to the downward movement of the first guiding component 32'. Motion of the second mask 68 may be or not be simultaneous with the downward movement of the first guiding component 32'. The second mask 68 can be moved in the second linear direction D2 to approach the third mask 70 and the first mask 66. As long as friction between the first guiding component 32' and the constraining component 72 is smaller than friction between the third mask 70 and the inner wall B of the cover 22, the second mask 68 can be lowered from a position shown in FIG. 22 to a position shown in FIG. 21, so that the volume of the resonance chamber 28 can be enlarged accordingly. A fourth movement of the operating component 36 can be continuously rotated in the second rotary direction R2; because the fourth movement is larger than the third movement, the first guiding component 32' still can be lowered to move the second mask 68 and the third mask 70 downwardly for approaching the first mask 66, such as from the position shown in FIG. 21 to the position shown in FIG. 20, so that the volume of the resonance chamber 28 can be further enlarged. Motion of the second mask 68 and the third mask 70 may be or not be simultaneous with the downward movement of the first guiding component 32'.

The seventh embodiment can provide some other possible embodiments. In a condition of the friction between the first guiding component 32' and the constraining component 72 being larger than the friction between the third mask 70 and the inner wall B of the cover 22, when the second mask 68 is lowered from the position shown in FIG. 22, the first guiding component 32' can move the second mask 68 in the second linear direction D2, and the third mask 70 can be downwardly moved in the second linear direction D2 with movements of the first guiding component 32' and the second mask 68. As the third mask 70 abuts against the first mask 66 and cannot be lowered, the second mask 68 still can be moved in the second linear direction D2 until the second mask 68 abuts against the third mask 70, so that the first mask 66, the second mask 68 and the third mask 70 of the plate 24" can be recovered from the position shown in FIG. 22 to the position shown in FIG. 20.

In conclusion, the speaker device of the present disclosure can include the acoustic deflecting module capable of changing structural parameters of the acoustic deflecting module and the opening structure. The acoustic deflecting module can adjust the volume of the resonance box, the aperture of the opening structure, and the depth of the opening structure to change the resonant frequency of the audio signal via a variety of structural design. In the first embodiment, the plate can be moved inside the chest structure in the stepless manner for changing the volume of the resonance chamber. In the second embodiment, the plate can be moved inside the chest structure via the multi-stage adjustment for changing the volume of the resonance chamber. In the third embodiment, the plate can be moved inside the second part of the cover in the stepless manner, for changing the volume of the resonance chamber formed by the pyramid-shaped first part and the column-shaped second part. In the fourth embodiment, the plate can be moved inside the second part of the cover via the multi-stage adjustment, for changing the volume of the resonance chamber formed by the pyramid-shaped first part and the column-shaped second part. In the fifth embodiment, the acoustic deflecting module can replace one cover by another cover with different thickness for changing the volume of the resonance chamber. In the sixth embodiment, the acoustic deflecting module can adjust the aperture of the opening structure for changing the frequency of the audio signal. In the seventh embodiment, the acoustic deflecting module can include the plate having some masks with different radial dimensions, and the masks are matched with the pyramid-shaped first part for changing the volume of the resonance chamber. Comparing to the prior art, the speaker device of the present disclosure can adjust the resonant frequency of the audio signal without changing outward appearance of the resonance box, and thus can provide preferred operation experience.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A speaker device having a resonance chamber with adjustable volume, the speaker device comprising:

a speaker chamber adapted to generate and output an audio signal outwardly; and an acoustic deflecting module disposed adjacent to the speaker chamber, an outer surface of the acoustic deflecting module being adapted to change a transmission direction of the audio signal, and an inner volume of the acoustic deflecting module being used as the resonance chamber with the adjustable volume, the acoustic deflecting module comprising:

a base;

a cover assembled with the base for providing an inner space;

a plate being a solid structure disposed inside the cover in a shiftable manner, an edge of the plate slidably abutting against an inner wall of the cover to divide the inner space into the resonance chamber and an accommodating chamber; and a driving mechanism disposed inside the accommodating chamber and assembled with the plate, and adapted to shift the plate relative to the cover for adjusting the volume of the resonance chamber.

2. The speaker device of claim 1, wherein the driving mechanism comprises:

a supporter disposed on the base;

a first guiding component having a first end and a second end opposite to each other, the first end being fixed to the plate and the second end being movably disposed on the supporter;

a second guiding component movably disposed between the first end and the second end of the first guiding component; and an operating component disposed on the cover and assembled with the second guiding component, a movement of the operating component along different rotary directions shifting the plate along different linear directions so as to enlarge or reduce the volume of the resonance chamber;

wherein the movement of the operating component in a first rotary direction shifts the plate in a first linear direction via the second guiding component and the first guiding component for reducing the volume, and the movement of the operating component in a second rotary direction opposite to the first rotary direction shifts the plate in a second linear direction opposite to the first linear direction via the second guiding component and the first guiding component for enlarging the volume;

wherein the supporter is a track, and the first guiding component and the second guiding component respectively are a rack and a gear, and the rack is slidably disposed inside the track to engage with the gear.

3. The speaker device of claim 1, wherein the plate comprises a first mask and a second mask, a radial dimension of the first mask is greater than a radial dimension of the second mask, and the driving mechanism comprises:

a supporter disposed on the base;

a first guiding component having a first end and a second end opposite to each other, the first end movably passing through the first mask to fix onto the second mask, and the second end being movably disposed on the supporter;

a second guiding component movably disposed between the first end and the second end of the first guiding component; and an operating component disposed on the cover and assembled with the second guiding component, the operating component utilizing a variety of movements to shift the second mask relative to the first mask for enlarging or reducing the volume of the resonance chamber;

wherein the cover has a first part and a second part, any two sectional surfaces of the first part parallel to each other have different sectional dimensions, any two sectional surfaces of the second part parallel to each other have the same sectional dimension, and the plate is movably disposed inside the second part;

wherein the first mask is fixed inside the cover, and the second mask is movably disposed on the first part, and the radial dimension of the second mask is greater than one sectional surface of the first part having the smallest sectional dimension;

wherein the movement of the operating component in a first rotary direction shifts the second mask far from the first mask via the second guiding component and the first guiding component for reducing the volume, and the movement of the operating component in a second rotary direction opposite to the first rotary direction shifts the second mask close to the first mask via the second guiding component and the first guiding component for enlarging the volume;

wherein the plate further comprises a third mask, a radial dimension of the third mask is set between the radial dimension of the first mask and the radial dimension of the second mask, the first end of the first guiding component movably passes through the first mask and the third mask to fix onto the second mask, the operating component utilize a variety of movements to shift the second mask and the third mask simultaneously, or shift the second mask relative to the third mask;

wherein the third mask is movably disposed on the first part, and located between the first mask and the second mask;

wherein a first movement of the operating component in the first rotary direction drives the third mask to push the second mask via the second guiding component and the first guiding component for reducing the volume, and a second movement of the operating component in the first rotary direction further drives the second mask far from the third mask via the second guiding component and the first guiding component for further reducing the volume, and the second movement is greater than the first movement;

wherein a third movement of the operating component in the second rotary direction moves the second mask close to the third mask via the second guiding component and the first guiding component for enlarging the volume, and a fourth movement of the operating component in the second rotary direction further moves the second mask and the third mask simultaneously close to the first mask via the second guiding component and the first guiding component for further enlarging the volume, and the fourth movement is greater than the third movement;

wherein the driving mechanism further comprises a constraining component disposed on the first guiding component, the constraining component being adapted to move the third mask and the second mask simultaneously in a first linear direction, and further to stay the third mask when the second mask shifts in a second linear direction opposite to the first linear direction;

wherein the constraining component is a block disposed on the first guiding component in a movable manner, and located between the first mask and the third mask.

4. An acoustic deflecting module with adjustable volume, comprising:

a base;

a cover assembled with the base for providing an inner space;

a plate being a solid structure disposed inside the cover in a shiftable manner, an edge of the plate slidably abutting against an inner wall of the cover to divide the inner space into the resonance chamber and an accommodating chamber; and a driving mechanism disposed on the cover and assembled with the plate, and adapted to shift the plate relative to the cover for adjusting the volume of the resonance chamber.

5. The acoustic deflecting module of claim 4, wherein the acoustic deflecting module is matched with a speaker chamber, an outer surface of the acoustic deflecting module is adapted to change a transmission direction of an audio signal generated by the speaker chamber, and an inner volume of the acoustic deflecting module is used as the resonance chamber with the adjustable volume.

6. The acoustic deflecting module of claim 4, wherein the driving mechanism comprises:

a supporter disposed on the base;

a first guiding component having a first end and a second end opposite to each other, the first end being fixed to the plate and the second end being movably disposed on the supporter;

a second guiding component movably disposed between the first end and the second end of the first guiding component; and an operating component disposed on the cover and assembled with the second guiding component, a movement of the operating component along different rotary directions shifting the plate along different linear directions so as to enlarge or reduce the volume of the resonance chamber;

wherein the movement of the operating component in a first rotary direction shifts the plate in a first linear direction via the second guiding component and the first guiding component for reducing the volume, and the movement of the operating component in a second rotary direction opposite to the first rotary direction shifts the plate in a second linear direction opposite to the first linear direction via the second guiding component and the first guiding component for enlarging the volume;

wherein the supporter is a track, and the first guiding component and the second guiding component respectively are a rack and a gear, and the rack is slidably disposed inside the track to engage with the gear.

7. The acoustic deflecting module of claim 4, further comprising:

a positioning mechanism disposed on the plate and adapted to restricting a relative movement between the plate and the cover.

8. The acoustic deflecting module of claim 7, wherein the positioning mechanism comprises a positioning component and a resilient component, the positioning component abuts against a positioning slot formed on the cover in a detachable manner, an end of the resilient component is connected to the positioning component and the other end of the resilient component is disposed inside an accommodating space of the plate.

9. The acoustic deflecting module of claim 4, wherein the cover has a chest structure, any two sectional surfaces of the chest structure parallel to each other have the same sectional dimension, and an edge of the plate movably abuts against an inner wall of the chest structure.

10. The acoustic deflecting module of claim 4, wherein the cover has a first part and a second part, any two sectional surfaces of the first part parallel to each other have different sectional dimensions, any two sectional surfaces of the second part parallel to each other have the same sectional dimension, and the plate is movably disposed inside the second part.

11. The acoustic deflecting module of claim 10, wherein the plate comprises a first mask and a second mask, a radial dimension of the first mask is greater than a radial dimension of the second mask, and the driving mechanism comprises:

a supporter disposed on the base;

a first guiding component having a first end and a second end opposite to each other, the first end movably passing through the first mask to fix onto the second mask, and the second end being movably disposed on the supporter;

a second guiding component movably disposed between the first end and the second end of the first guiding component; and an operating component disposed on the cover and assembled with the second guiding component, the operating component utilizing a variety of movements to shift the second mask relative to the first mask for enlarging or reducing the volume of the resonance chamber;

wherein the first mask is fixed inside the cover, the second mask is movably disposed on the first part, and the radial dimension of the second mask is greater than one sectional surface of the first part having the smallest sectional dimension;

wherein the movement of the operating component in a first rotary direction shifts the second mask far from the first mask via the second guiding component and the first guiding component for reducing the volume, and the movement of the operating component in a second rotary direction opposite to the first rotary direction shifts the second mask close to the first mask via the second guiding component and the first guiding component for enlarging the volume.

12. The acoustic deflecting module of claim 11, wherein the plate further comprises a third mask, a radial dimension of the third mask is set between the radial dimension of the first mask and the radial dimension of the second mask, the first end of the first guiding component movably passes through the first mask and the third mask to fix onto the second mask, the operating component utilizes a variety of movements to shift the second mask and the third mask simultaneously, or shift the second mask relative to the third mask, the third mask is movably disposed on the first part and located between the first mask and the second mask.

13. The acoustic deflecting module of claim 12, wherein a first movement of the operating component in the first rotary direction drives the third mask to push the second mask via the second guiding component and the first guiding component for reducing the volume, and a second movement of the operating component in the first rotary direction further drives the second mask far from the third mask via the second guiding component and the first guiding component for further reducing the volume, and the second movement is greater than the first movement.

14. The acoustic deflecting module of claim 13, wherein a third movement of the operating component in the second rotary direction moves the second mask close to the third mask via the second guiding component and the first guiding component for enlarging the volume, and a fourth movement of the operating component in the second rotary direction further moves the second mask and the third mask simultaneously close to the first mask via the second guiding component and the first guiding component for further enlarging the volume, and the fourth movement is greater than the third movement.

15. The acoustic deflecting module of claim 4, wherein the acoustic deflecting module further comprises two covers respectively having different thickness, and one of the two covers is assembled with the base in a detachable manner.

16. The acoustic deflecting module of claim 4, wherein the cover comprises an opening structure, and the acoustic deflecting module further comprises a sheltering mechanism disposed on the cover to shelter the opening structure in a switchable manner.

17. The acoustic deflecting module of claim 16, wherein the sheltering mechanism comprises:

a plurality of sheltering components movably disposed on the cover in a partly overlapped manner;

a bridging component connected to the plurality of sheltering components; and a controlling component movably disposed on the cover and connected to the bridging component, a movement of the controlling component shifting the plurality of sheltering components in a relative manner via the bridging component for sheltering or exposing the opening structure.

18. The acoustic deflecting module of claim 12, wherein the driving mechanism further comprises a constraining component disposed on the first guiding component, the constraining component moves the third mask and the second mask simultaneously in a first linear direction, and further to stay the third mask when the second mask shifts in a second linear direction opposite to the first linear direction.

19. The acoustic deflecting module of claim 18, wherein the constraining component is a block disposed on the first guiding component in a movable manner, and located between the first mask and the third mask.

* * * * *